US009046230B2

(12) United States Patent
O'Brien

(10) Patent No.: US 9,046,230 B2
(45) Date of Patent: Jun. 2, 2015

(54) MODULAR FLASHLIGHT SYSTEM

(71) Applicant: TACTICAL IMPULSE LLC, Arlington, TX (US)

(72) Inventor: Paul O'Brien, Arlington, TX (US)

(73) Assignee: Tactical Impulse LLC, Arlington, TX (US)

( * ) Notice: Subject to any disclaimer, the term of this patent is extended or adjusted under 35 U.S.C. 154(b) by 185 days.

(21) Appl. No.: 13/749,636

(22) Filed: Jan. 24, 2013

(65) Prior Publication Data

US 2013/0265749 A1 Oct. 10, 2013

Related U.S. Application Data

(60) Provisional application No. 61/589,944, filed on Jan. 24, 2012.

(51) Int. Cl.

| | |
|---|---|
| ***F21L 4/02*** | (2006.01) |
| ***F21L 4/08*** | (2006.01) |
| ***F21V 23/04*** | (2006.01) |
| ***F21L 4/00*** | (2006.01) |
| *F21Y 101/02* | (2006.01) |

(52) U.S. Cl.

CPC ..... *F21L 4/005* (2013.01); *F21L 4/022* (2013.01); *F21L 4/027* (2013.01); *F21L 4/08* (2013.01); *F21V 23/0421* (2013.01); *F21Y 2101/02* (2013.01); *F21V 23/0442* (2013.01)

(58) Field of Classification Search

CPC ..... F21L 4/005; F21L 4/022; F21L 4/027; F21L 4/08; F21V 23/0442; F21V 23/0421; F21Y 2101/02

USPC ..... 362/183, 190, 191, 194, 197, 202–208, 362/276, 802

See application file for complete search history.

(56) References Cited

U.S. PATENT DOCUMENTS

| | | | | |
|---|---|---|---|---|
| 5,197,796 | A * | 3/1993 | Moore | 362/202 |
| 5,536,979 | A * | 7/1996 | McEachern et al. | 307/104 |
| 6,013,985 | A * | 1/2000 | Green et al. | 315/149 |
| 6,043,626 | A * | 3/2000 | Snyder et al. | 320/113 |
| 6,652,115 | B2 | 11/2003 | Sharrah | |
| 6,652,116 | B2 * | 11/2003 | Dickinson | 362/202 |
| 7,121,688 | B2 * | 10/2006 | Rempel | 362/249.11 |
| 7,393,120 | B2 | 7/2008 | Kang et al. | |
| 7,422,344 | B2 * | 9/2008 | Wu et al. | 362/184 |
| 7,527,388 | B2 * | 5/2009 | Kim | 362/205 |
| 7,631,984 | B2 * | 12/2009 | Martin et al. | 362/205 |
| 7,635,197 | B2 * | 12/2009 | Man | 362/202 |
| 7,674,003 | B2 | 3/2010 | Sharrah et al. | |
| 2008/0055891 | A1 | 3/2008 | Mattheis | |

* cited by examiner

*Primary Examiner* — Alan Cariaso
(74) *Attorney, Agent, or Firm* — Howison & Arnott, LLP

(57) ABSTRACT

A modular flashlight and a modular flashlight system are provided. In one example, the modular flashlight includes a base configuration that can be modified with a modular extension unit.

21 Claims, 25 Drawing Sheets

MODULAR FLASHLIGHT SYSTEM

CROSS-REFERENCE TO RELATED APPLICATIONS

This application claims benefit of U.S. Provisional Application No. 61/589,944, filed Jan. 24, 2012, and entitled LED FLASHLIGHT SYSTEM.

BACKGROUND

Flashlights are expected to provide reliability in their primary function of area illumination. Reliable functionality is particularly important for the military and first responders such as police officers, firefighters, and other emergency service personnel who are expected to discharge their duties regardless of the conditions in which they find themselves. Many military, first responder, and other professionals carry their flashlights whenever they are on duty and may use them for any number of tasks in addition to area illumination even though their flashlights may not be well suited for such tasks. Accordingly, improvements are needed to provide additional functionality to flashlights.

BRIEF DESCRIPTION OF THE DRAWINGS

For a more complete understanding, reference is now made to the following description taken in conjunction with the accompanying Drawings in which.

DETAILED DESCRIPTION

Figure 1A:
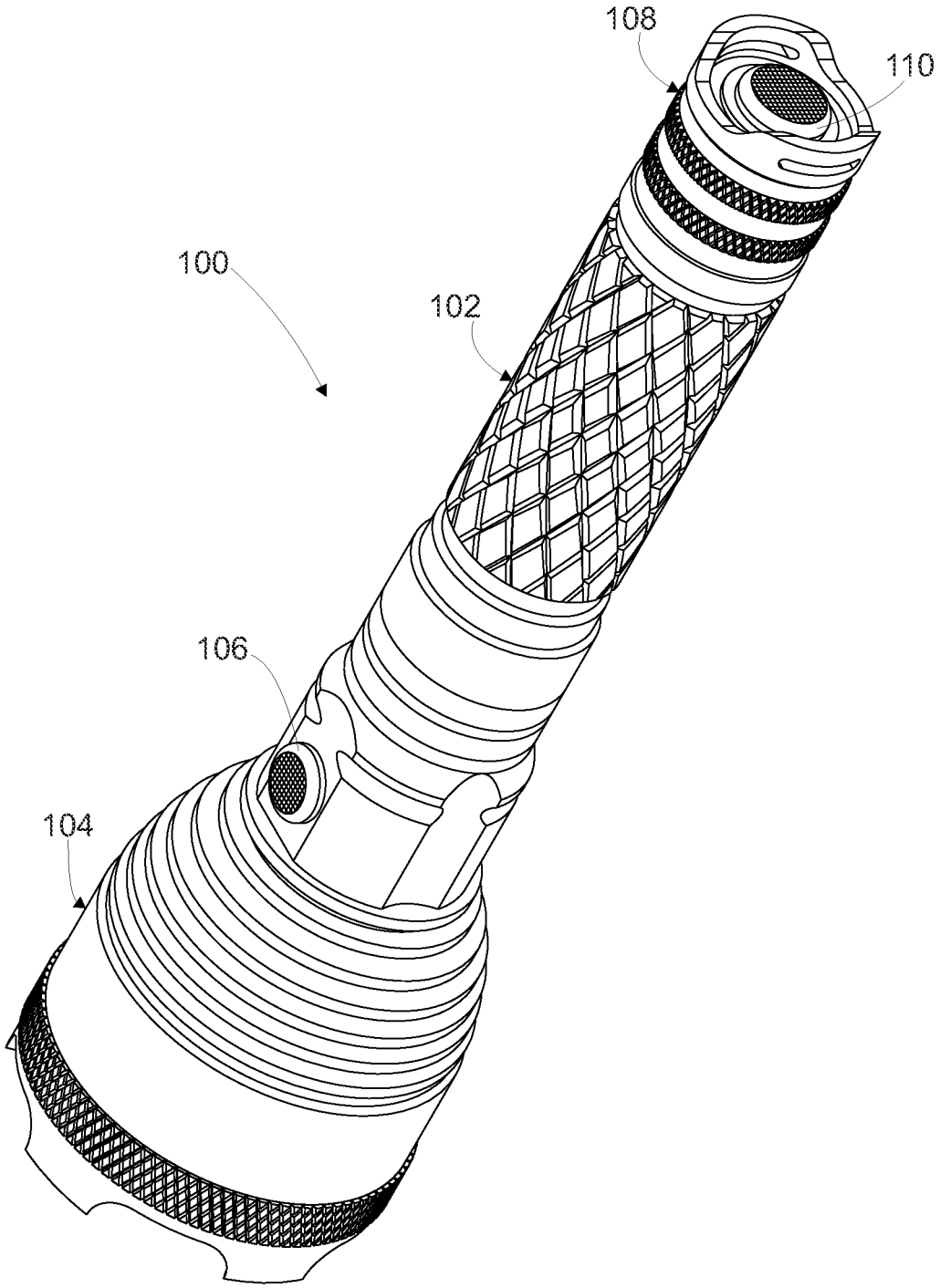
FIG. 1A illustrates a perspective view of one embodiment of a flashlight.

Referring now to the drawings, wherein like reference numbers are used herein to designate like elements throughout, the various views and embodiments of a modular flashlight and a modular flashlight system are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 1B:
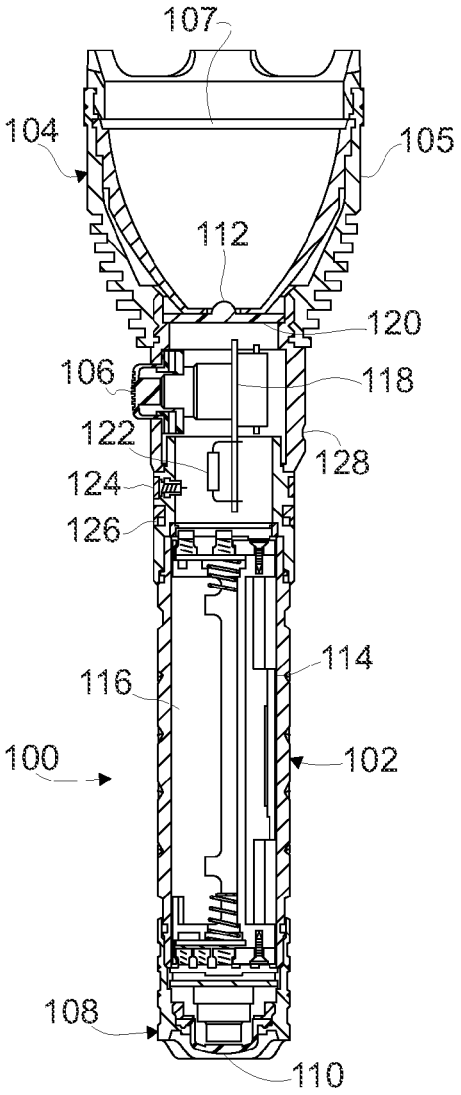
FIG. 1B illustrates a cross-sectional view of one embodiment of the flashlight of FIG. 1A.

Referring to FIGS. 1A and 1B, one embodiment of a modular flashlight 100 is illustrated in a base configuration. As will be described in detail in the following disclosure, the flashlight 100 may be operated in the base configuration and may also be reconfigured from the base configuration with various modular extension units to provide additional functionality depending on which modular extension unit is used with the base configuration. The modular extension units are easily transportable and may be attached and detached as needed. In some embodiments, a modular extension unit may provide functions that are not provided by the base configuration of the flashlight 100. In other embodiments, a modular extension unit may support the base configuration without providing additional functionality.

In the present example, the flashlight 100 includes a base configuration that is formed by a substantially cylindrical housing 102 coupled to or including a head 104. It is understood that the housing 102 and head 104 may overlap or otherwise merge in different ways depending on the particular design of the flashlight 100. Accordingly, features described herein as positioned on or near the head 104 may be on the housing 102 in some embodiments or vice versa.

The base configuration includes a head mounted switch 106 positioned on or near the head 104. The illustrated base configuration also includes a tail cap 108 having a tail mounted switch 110. Accordingly, the base configuration provides the two switches 106 and 110, either of which can toggle a light source 112.

The head 104 provides a substantially conical covering 105 and a lens 107 configured to protect a light source 112 that is coupled to the housing 102. In some embodiments, the covering 105 may have a reflective interior coating and be shaped to direct light from the flashlight 100. The light source 112 is a light emitting diode (LED) in the present embodiment, but it is understood that other types of light sources may be used. Although a single LED is used for purposes of example, it is understood that multiple LEDs may be used.

The LED 112 may be cycled through two or more states using either of the switches 106 and 110. In the present embodiment, the states include an OFF state and multiple ON states, such as a HIGH state, a MEDIUM state, a LOW state, and a STROBE state. The HIGH, MEDIUM, and LOW states indicate relative output intensity of the LED 112. The STROBE state provides an automated varying output intensity that may range from the HIGH state to the LOW state or OFF state, or may be based on other states (e.g., HIGH to MEDIUM or MEDIUM to LOW). The STROBE state may be configured to increase and/or decrease in intensity (e.g., pulse) until the next state is reached and/or may flip directly between states (e.g., flash).

One or both of the switches 106 and 110 may differentiate between levels of pressure applied to the switch. For example, a relatively light pressure may actuate the switch and activate the LED 112, but such pressure may be continually required if the LED 112 is to remain activated (e.g., the switch serves as a momentary contact switch such as a "push-to-make" switch). Removal of the pressure will turn off the LED 112. A higher level of pressure that crosses a pressure threshold may actuate the switch and result in constant activation of the LED 112 even when the pressure is removed (e.g., the switch serves as a constant contact switch). The LED 112 may remain on until an amount of pressure that also crosses the pressure threshold is again applied to deactivate the LED 112. The application of pressure great enough to cross the pressure threshold may result in feedback (e.g., tactile feedback and/or audio feedback, such as a "click" sound) to provide the user with an indication that the LED 112 is locked in the ON state.

Referring specifically to FIG. 1B, a cross-sectional view of the housing 102 and head 104 is illustrated. The housing 102 includes a cavity 114, which may be accessed by removal of the tail cap 108. The cavity 114 is configured to receive a battery holder 116, which will be described in greater detail below. One or more batteries in the battery holder 116 provide power for a control board 118 and an LED board 120. The control board 118 provides functionality for receiving switch input, providing state transitions (e.g., OFF, HIGH, MEDIUM, LOW, and STROBE), and activating/deactivating the LED 112. The LED board 120 drives the LED 112. It is understood that additional circuit boards may be used, the circuit boards 118 and 120 may be combined, and/or functionality may be distributed differently than is described in the present example.

A sensor 122 may be coupled to the control board 118 to provide automatic shutoff functionality to the flashlight 100. As will be described later, a retention device (e.g., a holster) or another device (e.g., a recharging unit) that is configured for the flashlight 100 may include a component (e.g., a magnet, tag, or other emitter) matched to the sensor 122. In the present example, the sensor 122 is a magnetically actuated sensor that responds to the presence of a magnetic field (e.g., a Reed switch) and the matching component would generate a magnetic field detectable by the sensor 122 when the flashlight 100 is properly holstered or placed into the recharging unit. In other embodiments, a radio frequency identification (RFID) reader or other types of sensors may be used as long as the component in the holster or recharging unit is of the proper type (e.g., an RFID tag).

In operation, when the sensor 122 detects the presence of the magnetic field, the sensor 122 will shut off the LED 112 if the LED is on. This may save time for a user while discontinuing use of the flashlight 100 since the user can simply holster the flashlight 100 and does not have to manually actuate one of the switches 106 or 110. If the LED 112 is off when the sensor 122 detects the presence of the magnetic field, the sensor 122 will prevent switches 106 and 110 from activating the LED 112. This may prevent inadvertent activation of the LED 112 when holstered.

Contacts 124 and 126 may completely or partially encircle the flashlight 100. As will be described later, the contacts 124 and 126 may be used to electrically couple the battery holder 116 to a recharging unit. One or more notches 128 may be positioned on or near the head 104. As will be described later, the notches 128 may be used to position the flashlight 100 within a retention device and/or to align and seat the contacts 124 and 126 with contacts in the recharging unit.

Figure 2A:
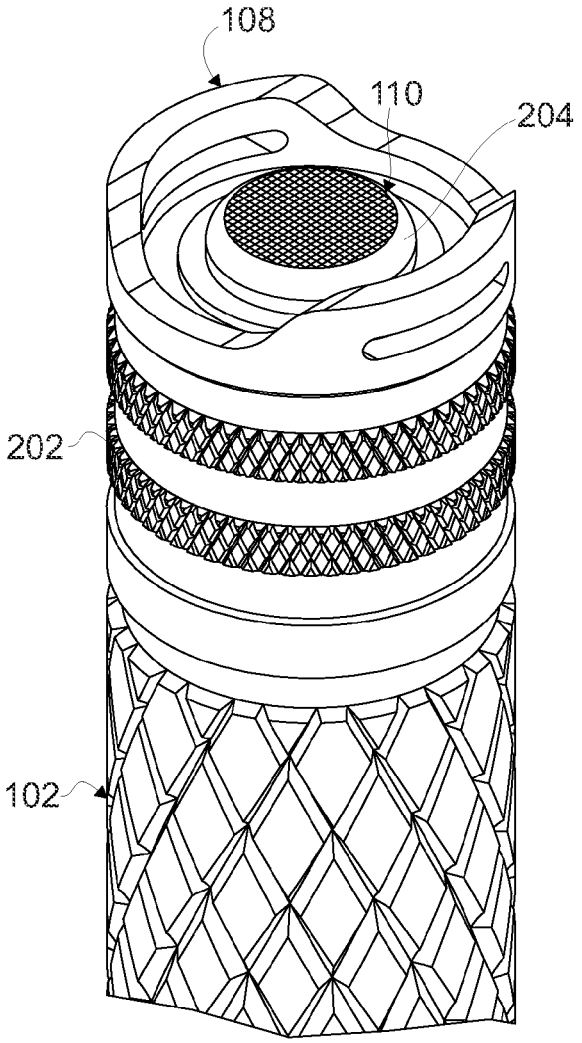
FIG. 2A illustrates a perspective view of one embodiment of a tail cap that may form part of the flashlight of FIG. 1A.
Figure 2B:
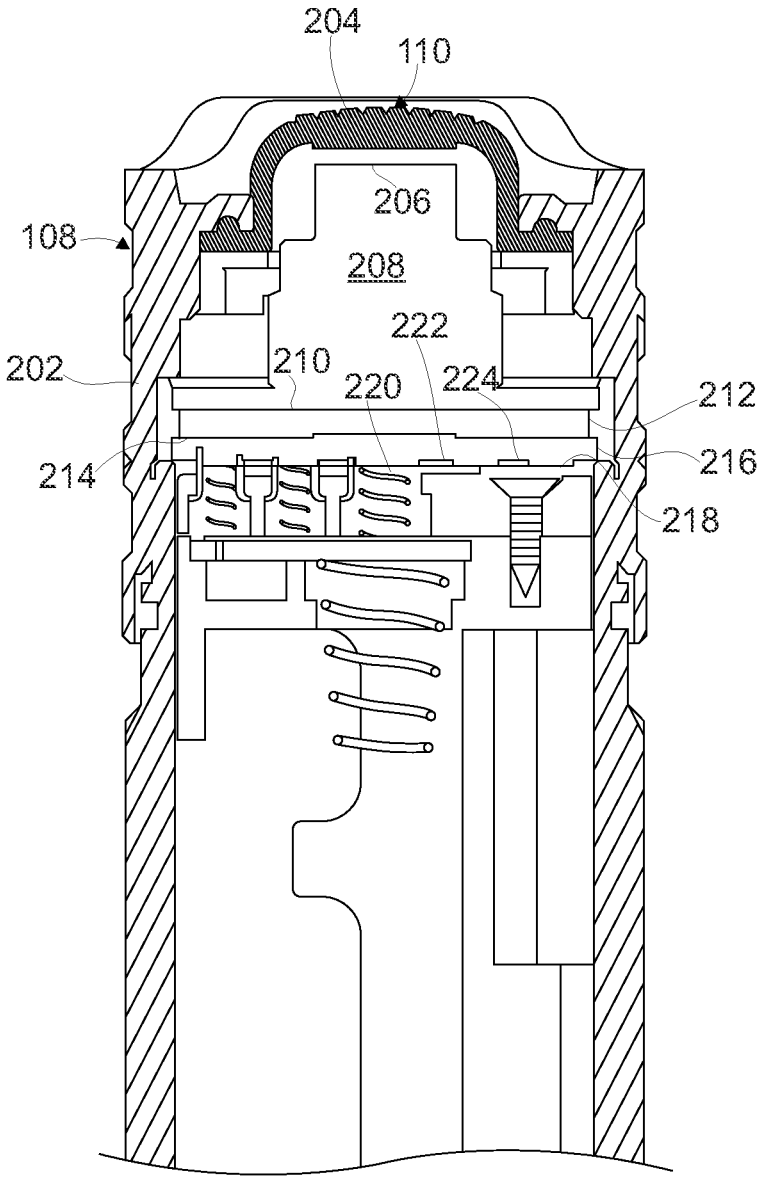
FIGS. 2B and 2C illustrate cross-sectional views of one embodiment of the tail cap of FIG. 2A.
Figure 2C:
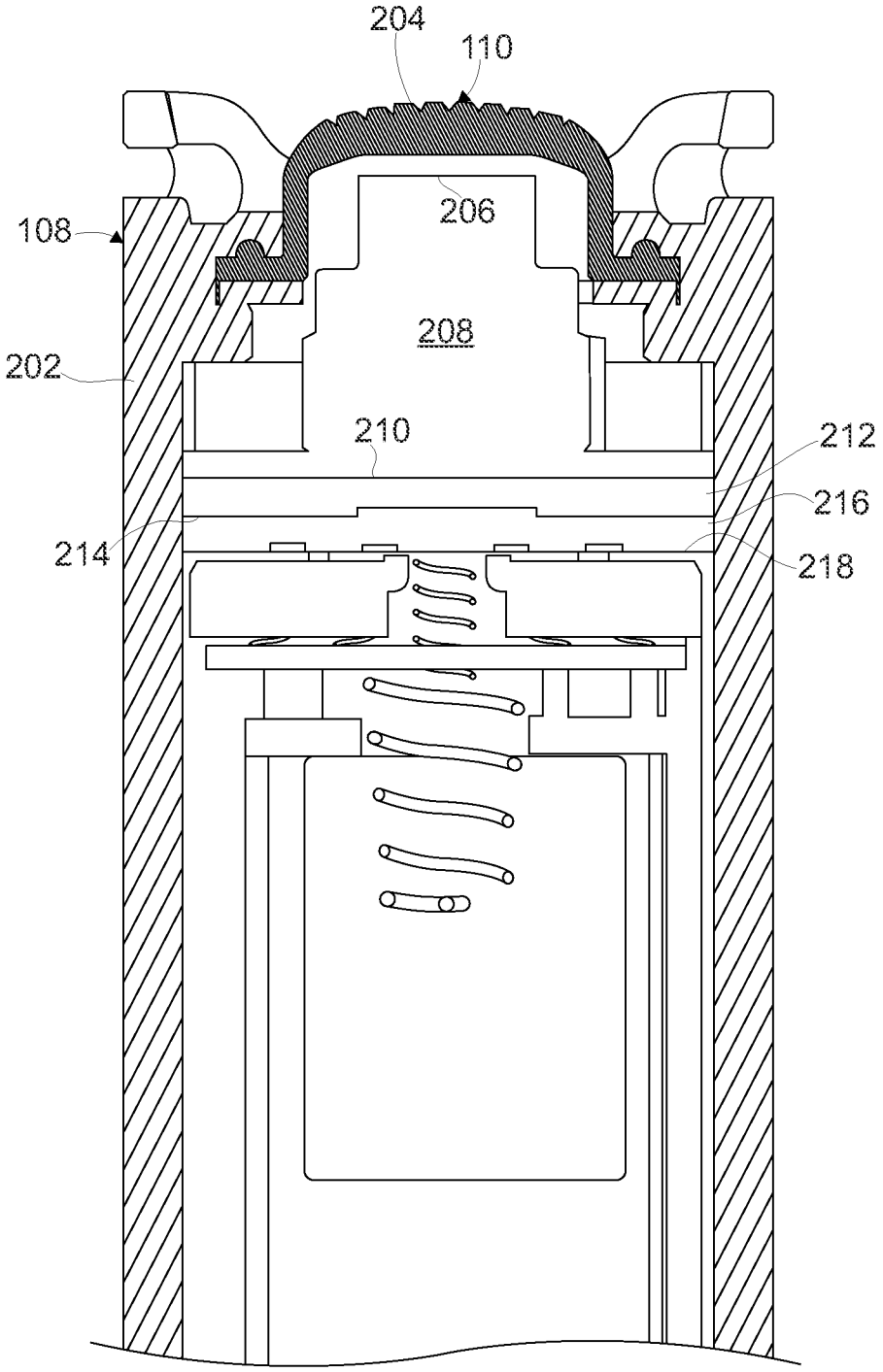

Referring to FIGS. 2A-2C, a more detailed embodiment of the tail cap 108 is illustrated. The tail cap 108 includes a housing 202 that forms a support platform for the switch 110. The switch 110 may include a switch cover 204 that engages an upper surface 206 of a switch mechanism 208 when actuated. Actuation of the switch 110 sends a signal to the control board 118, enabling the switch 110 to control the LED 112.

A lower surface 210 of the switch mechanism 208 forms a cavity 212 with an upper surface 214 of a lower member 216. The cavity 212 is sized to provide a gap between the lower surface 210 and the upper surface 214. Conductive traces and/or contacts may be provided on the upper surface 214 and, in some embodiments, on the lower surface 210. When the switch mechanism 208 is pressed, the gap is lessened and the switch actuation can be detected. For example, the middle of the lower surface 210 may contact the middle of the upper surface 214, completing a circuit via a contact 220. A lower surface 218 of the lower member 216 is configured to electrically engage the battery holder 116. The lower surface 218 includes three separate contacts 220, 222, and 224 (e.g., partial or complete concentric metal circles and/or other contact shapes) that are positioned to engage opposing contacts on the battery holder 116. As will be described below, the lower surface 218 provides contacts and traces that are needed to complete the main circuit in order for the flashlight 100 to operate.

Figure 3A:
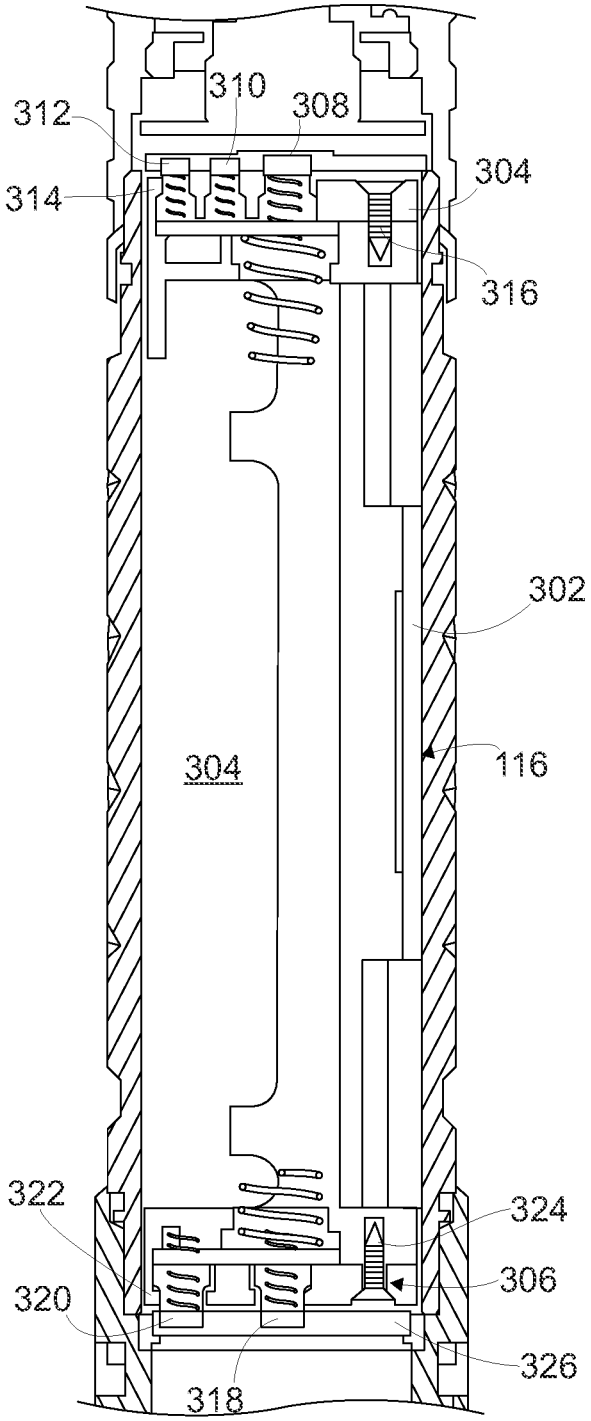
FIGS. 3A and 3B illustrate cross-sectional views of one embodiment of a battery holder that may form part of the flashlight of FIG. 1A.
Figure 3B:
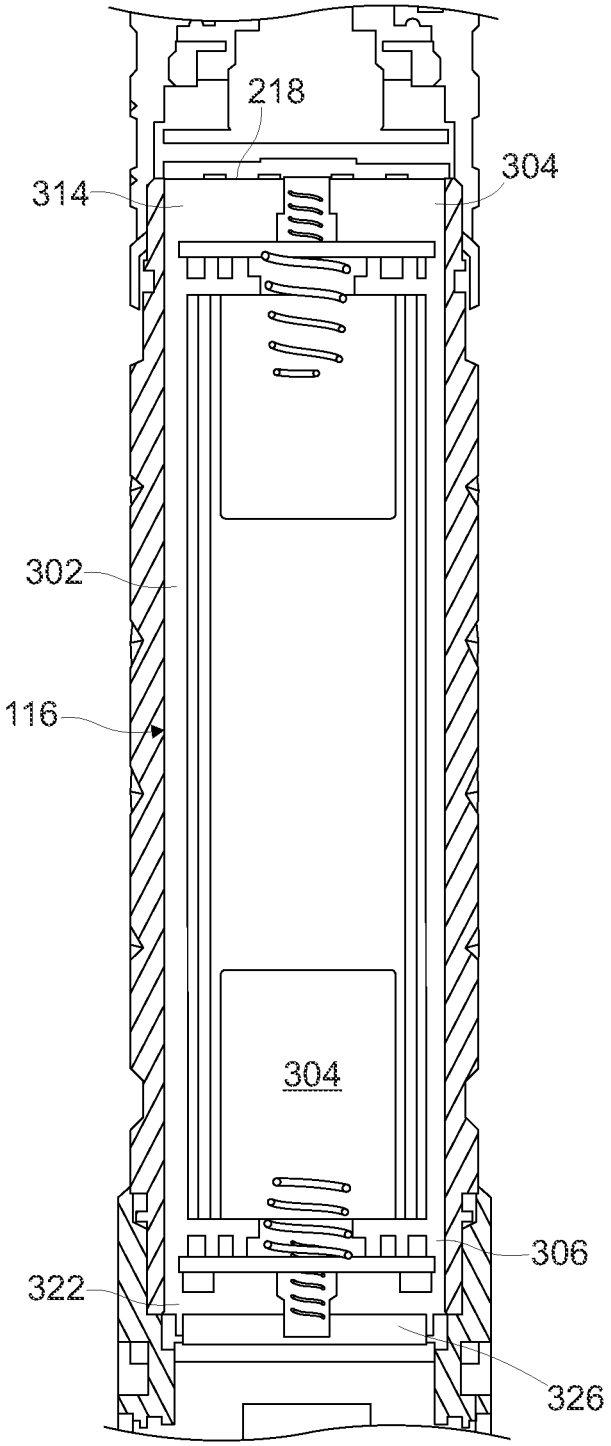

Referring to FIGS. 3A and 3B, one embodiment of the battery holder 116 is illustrated in greater detail. The battery holder 116 includes a removable battery housing 302 with an interior cavity 304 sized to receive a battery (not shown). Although the present example uses a rechargeable Lithium Ion (Li-ion) battery such as an 18650, it is understood that the battery holder 116 may be configured to receive many different rechargeable or non-rechargeable battery types and sizes. One end 304 of the battery holder 116 abuts the tail cap 108 and the other end 306 faces the control board 118. Both ends 304 and 306 provide a positive terminal and a negative terminal. For example, the end 304 may include a main negative contact 308 and an additional positive/negative contact pair 310 and 312. The end 306 may include a main positive contact 318 and an additional negative contact 320. It is understood that the polarity and position of a particular contact may be different in other embodiments, as long as both ends 304 and 306 provide both a positive terminal and a negative terminal. Traces (not shown) run along the battery housing 302 to provide power and/or signal paths between the ends 304 and 306. This enables the battery holder 116 to provide power to the two circuit boards 118 and 120 and also to provide power to and/or receive power from a module that is used to replace the tail cap 108.

In the present embodiment, the end 304 includes three contacts 308, 310, and 312 that extend through an end cap 314 and are positioned to contact the three contacts on the lower surface 218 of the tail cap 108. In some embodiments, the contacts 308, 310, and 312 may be spring loaded to ensure that they securely engage the contacts in the tail cap 108 while allowing for some depression into the battery holder 116. The end cap 314 may be coupled to the housing 302 using a screw 316 or other coupling mechanism.

The end 306 includes two contacts 318 and 320 that extend through an end cap 322 and are positioned to contact two contacts positioned on a substrate 326 of the housing 102. The substrate 326 is electrically coupled to the control board 118 and supplies power from the contacts 318 and 320 to the control board 118. In some embodiments, the contacts 318 and 320 may be spring loaded to ensure that they securely engage the contacts on the substrate 326 while allowing for some depression into the battery holder 116. The end cap 322 may be coupled to the housing 302 using a screw 324 or other coupling mechanism.

Figure 4:
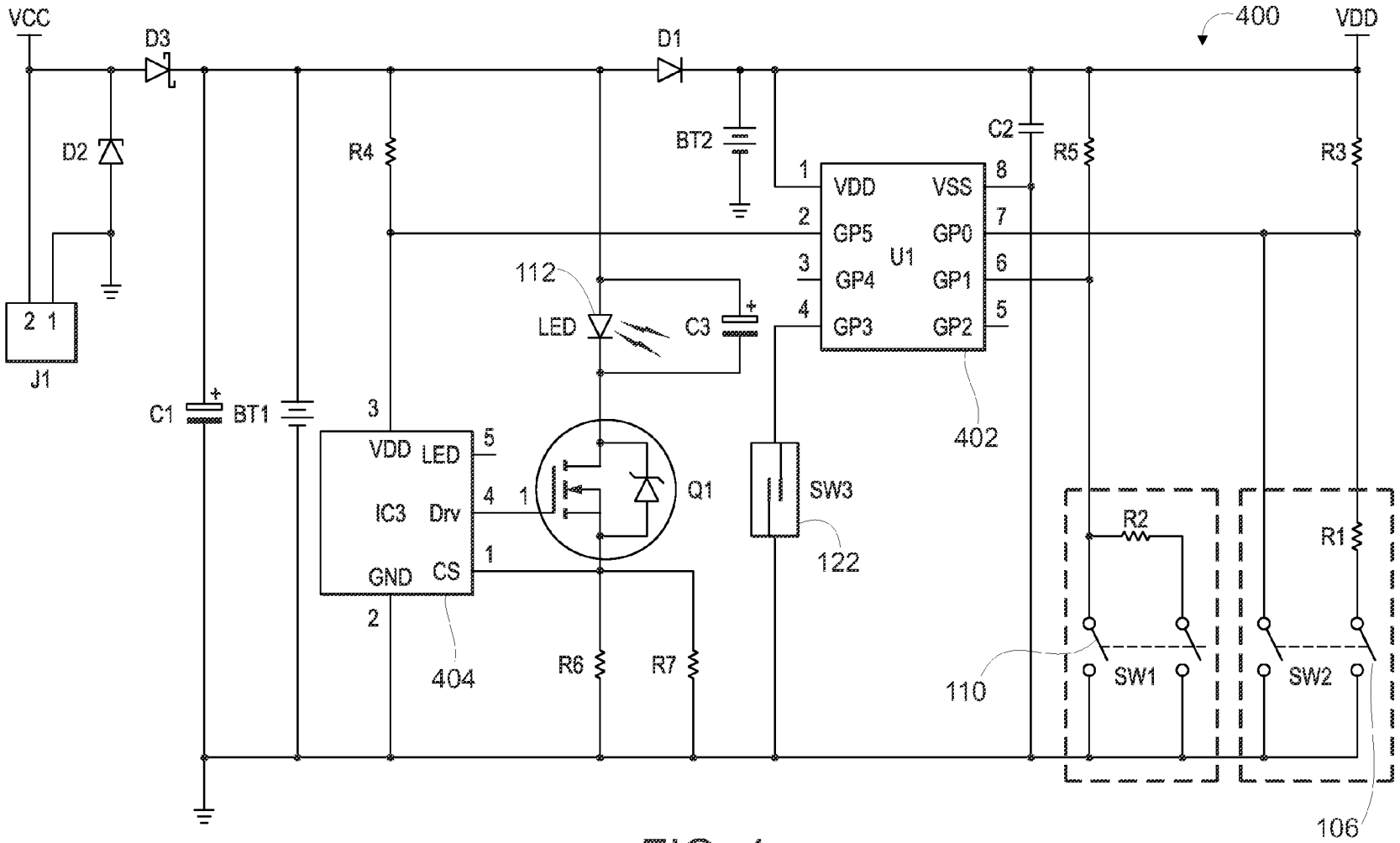
FIG. 4 illustrates a diagram of one embodiment of a circuit that may be used in the flashlight of FIG. 1A.
Figure 5A:
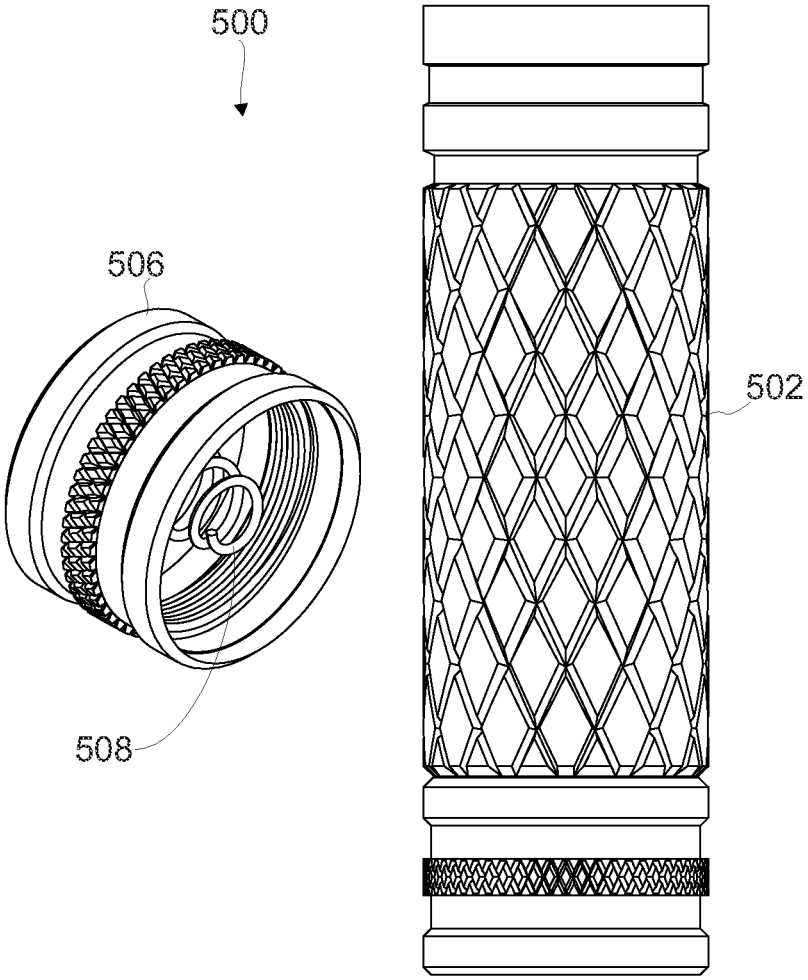
FIG. 5A illustrates one embodiment of a modular extension unit that may be used with the flashlight of FIG. 1A.
Figure 5B:
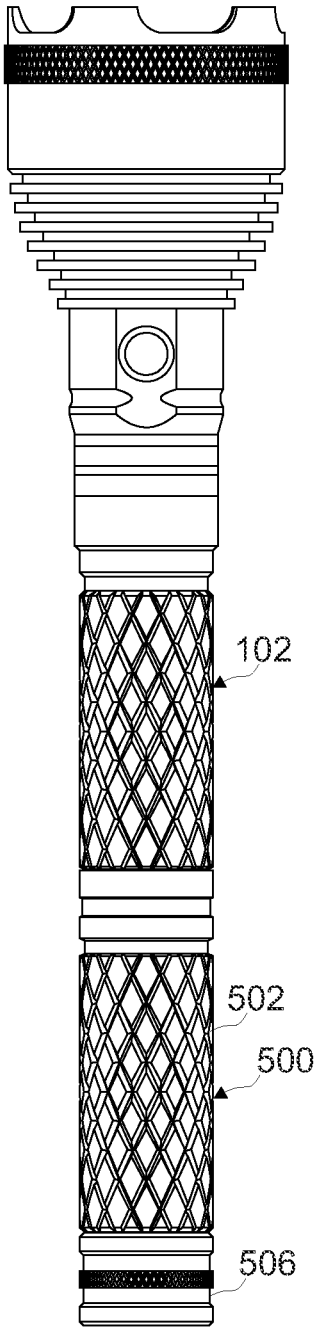
FIGS. 5B and 5C illustrate side and cross-sectional views, respectively, of embodiments of the modular extension unit of FIG. 5A coupled to the flashlight of FIG. 1A.
Figure 5C:
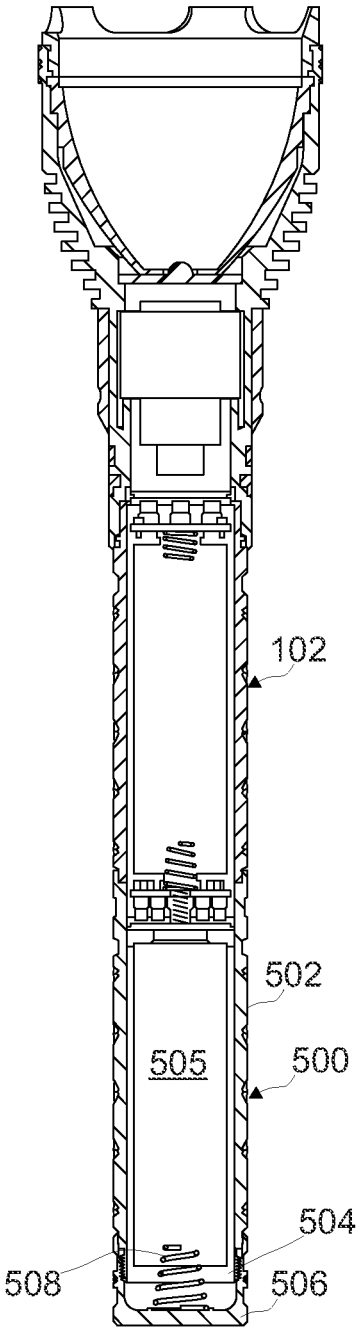
Figure 5D:
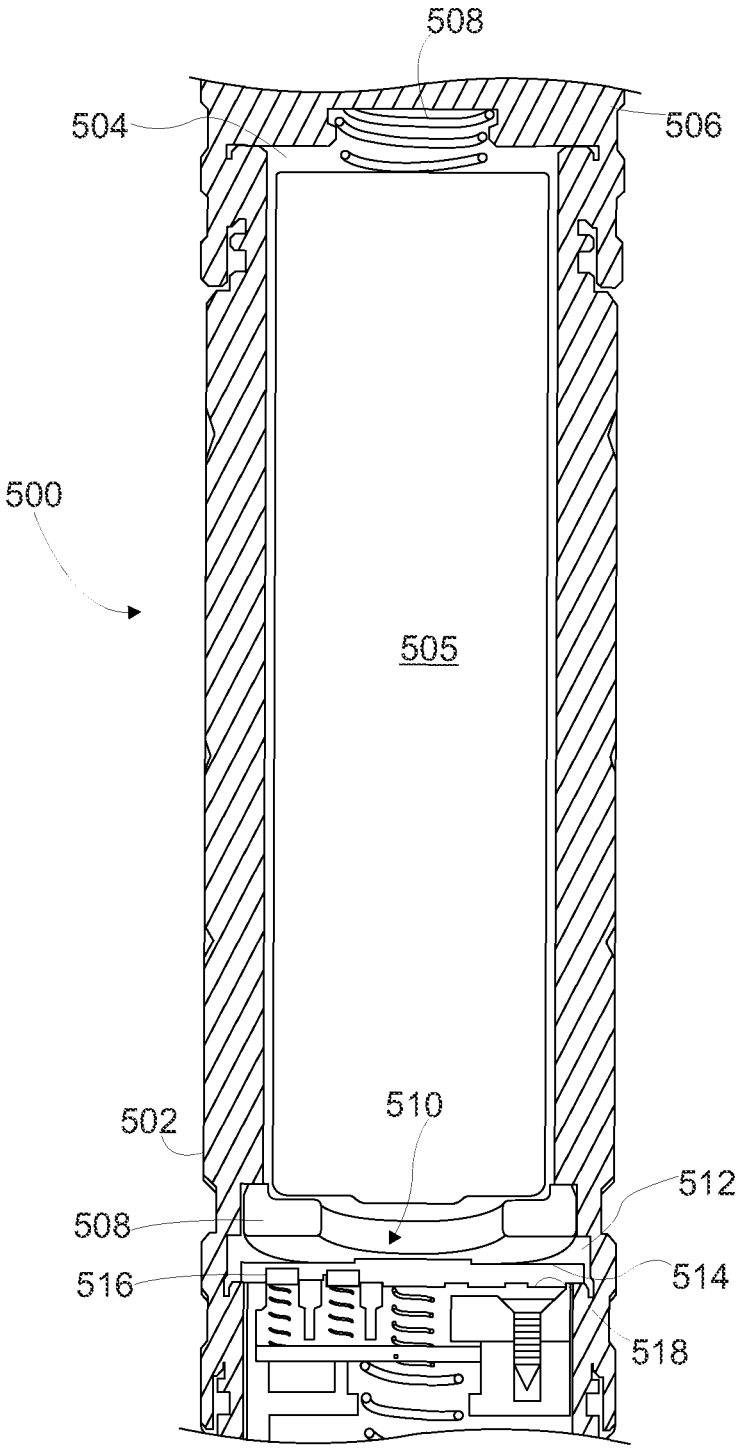
FIGS. 5D and 5E illustrate more detailed embodiments of the modular extension unit of FIG. 5C.
Figure 5E:
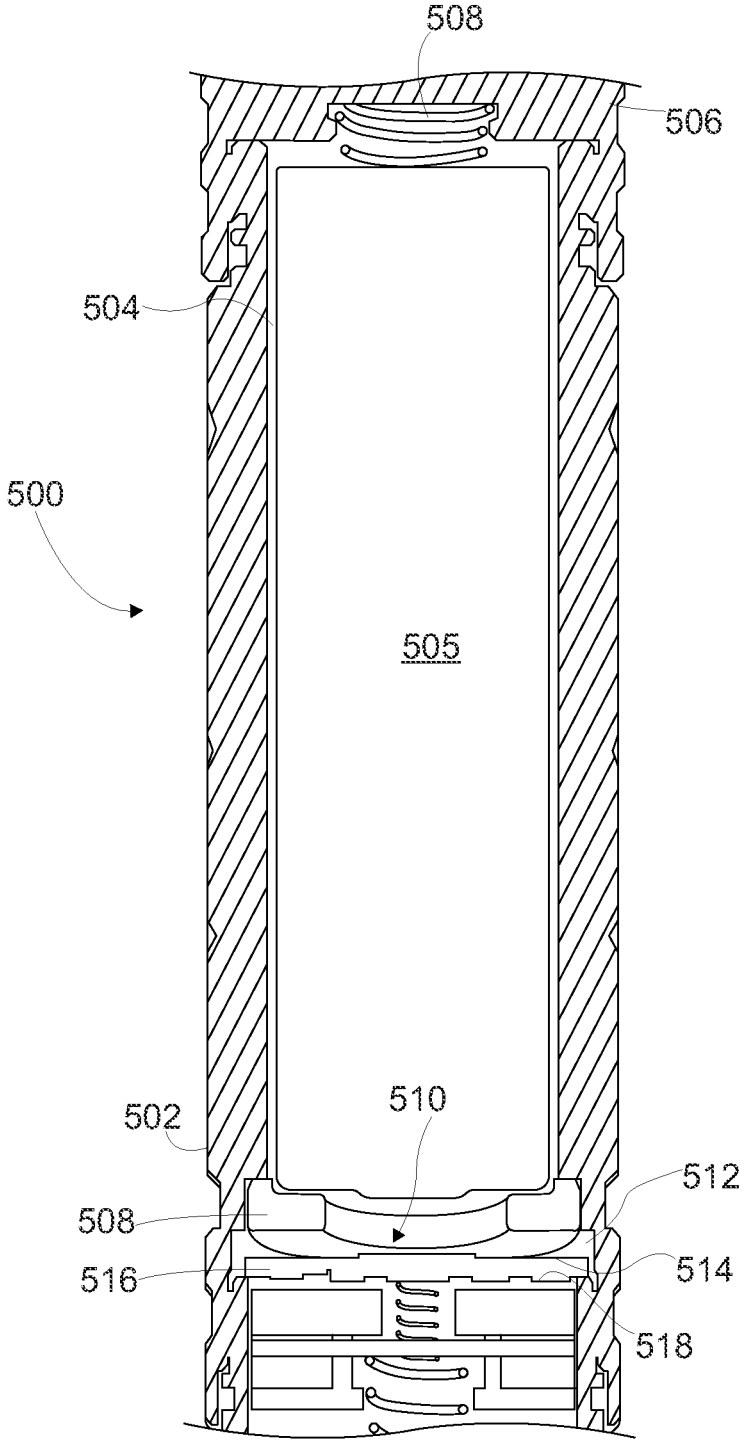
Figure 6A:
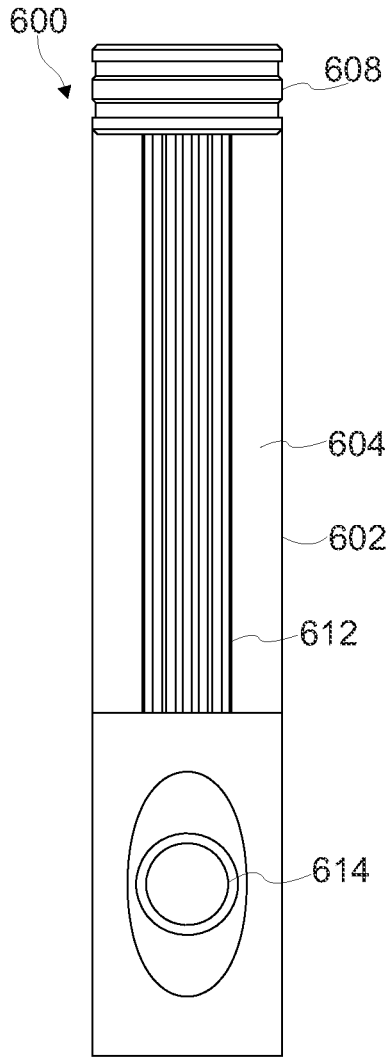
FIGS. 6A and 6B illustrate side and perspective views, respectively, of another embodiment of a modular extension unit that may be used with the flashlight of FIG. 1A.
Figure 6B:
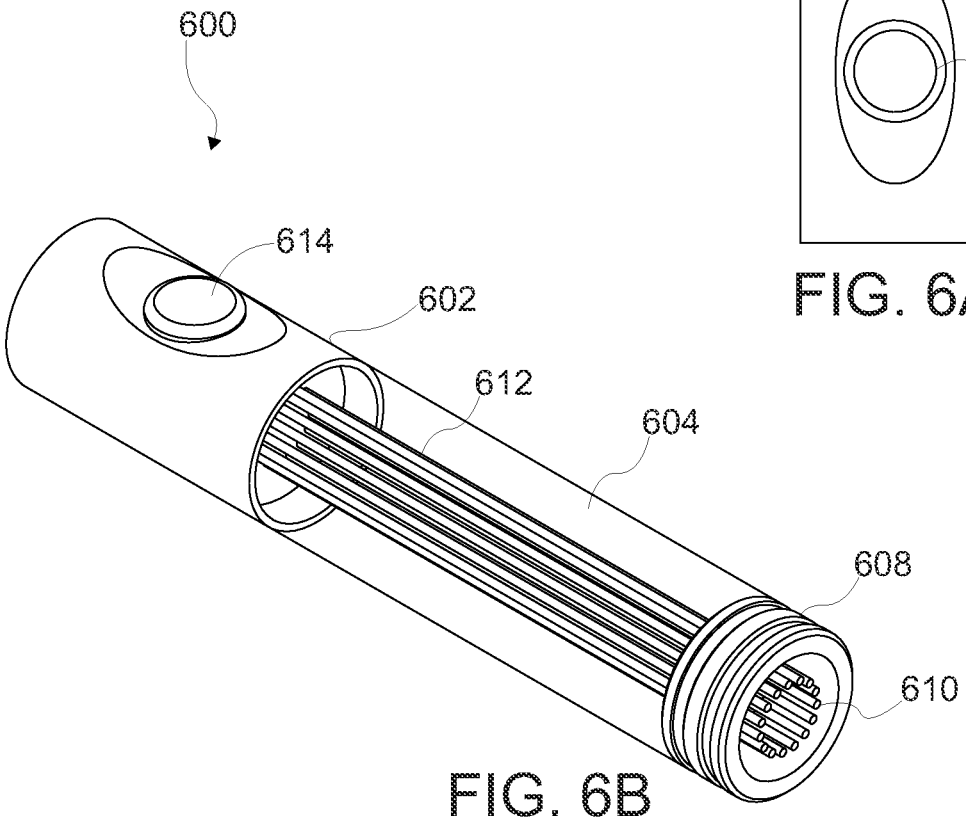
Figure 6C:
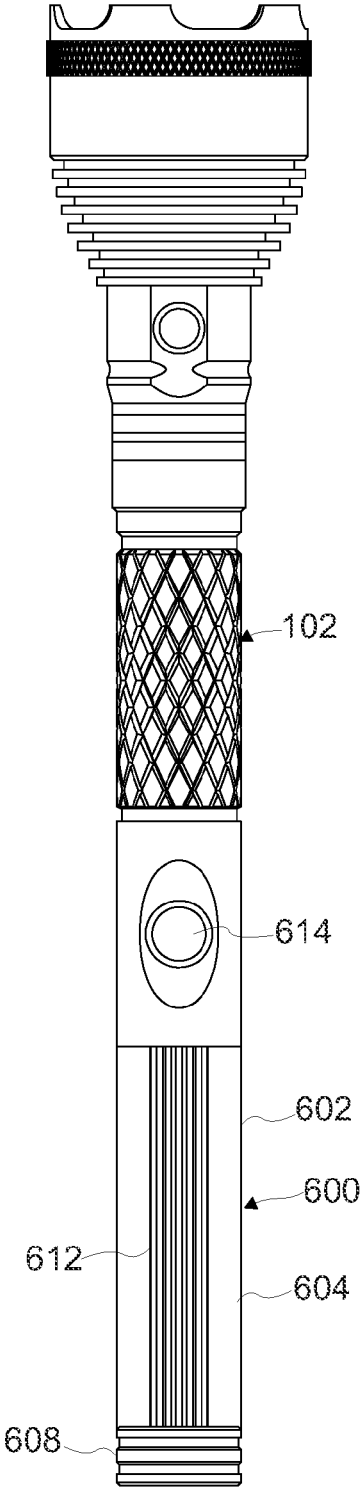
FIGS. 6C and 6D illustrate side and cross-sectional views, respectively, of embodiments of the modular extension unit of FIGS. 6A and 6B coupled to the flashlight of FIG. 1A.
Figure 6D:
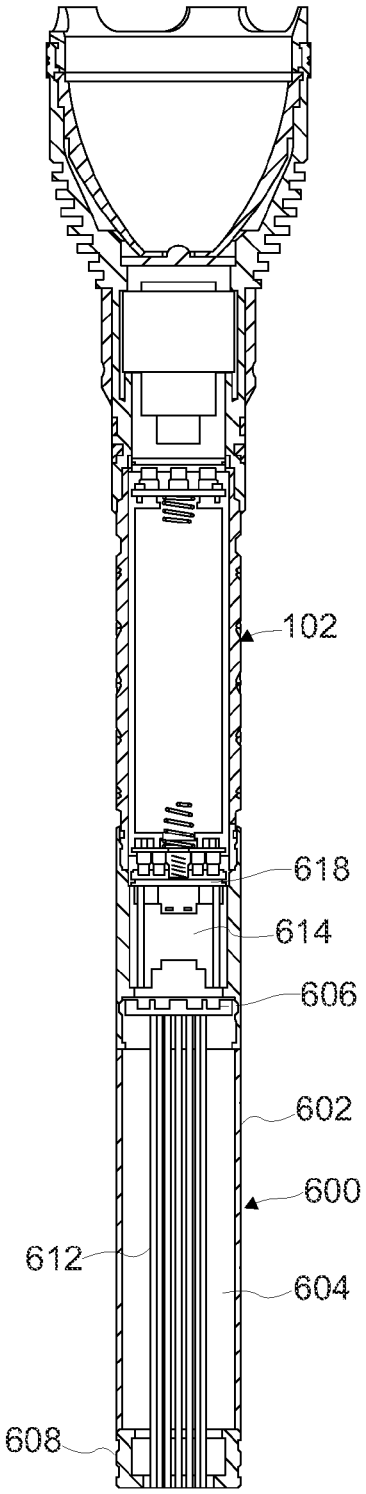
Figure 6E:
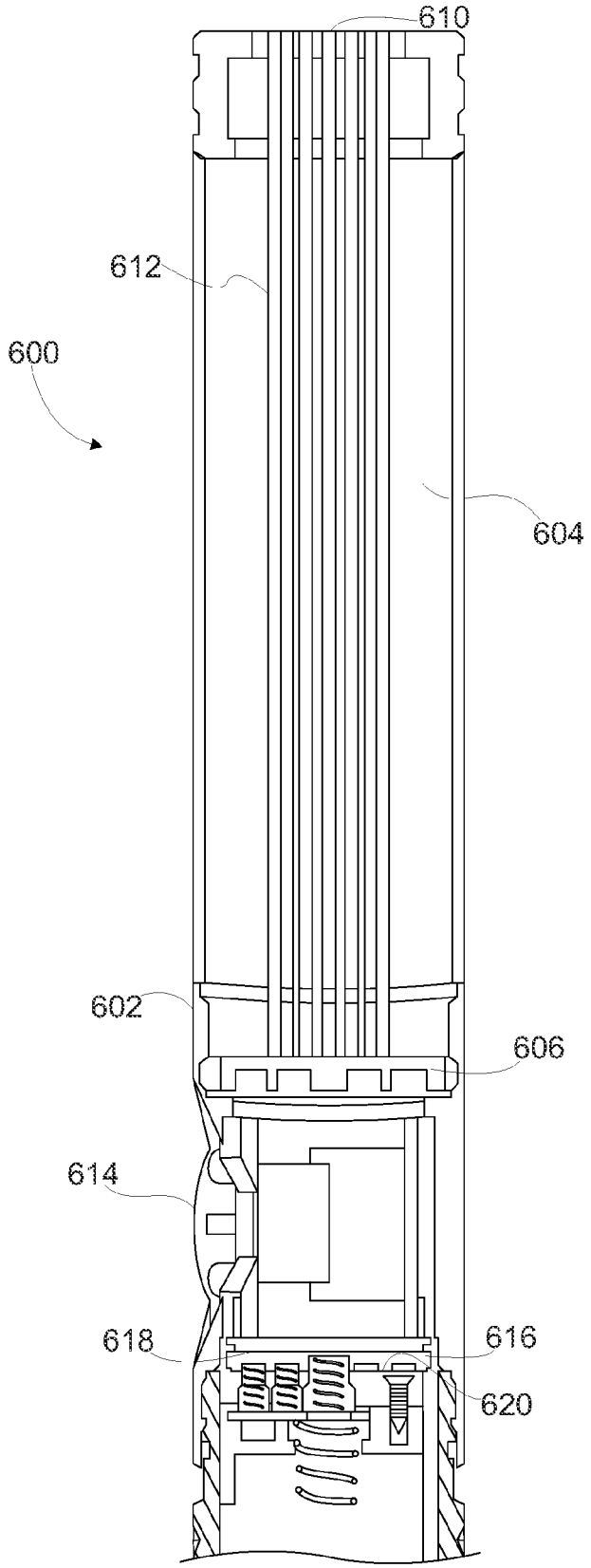
FIGS. 6E and 6F illustrate more detailed embodiments of the modular extension unit of FIG. 6D.
Figure 6F:
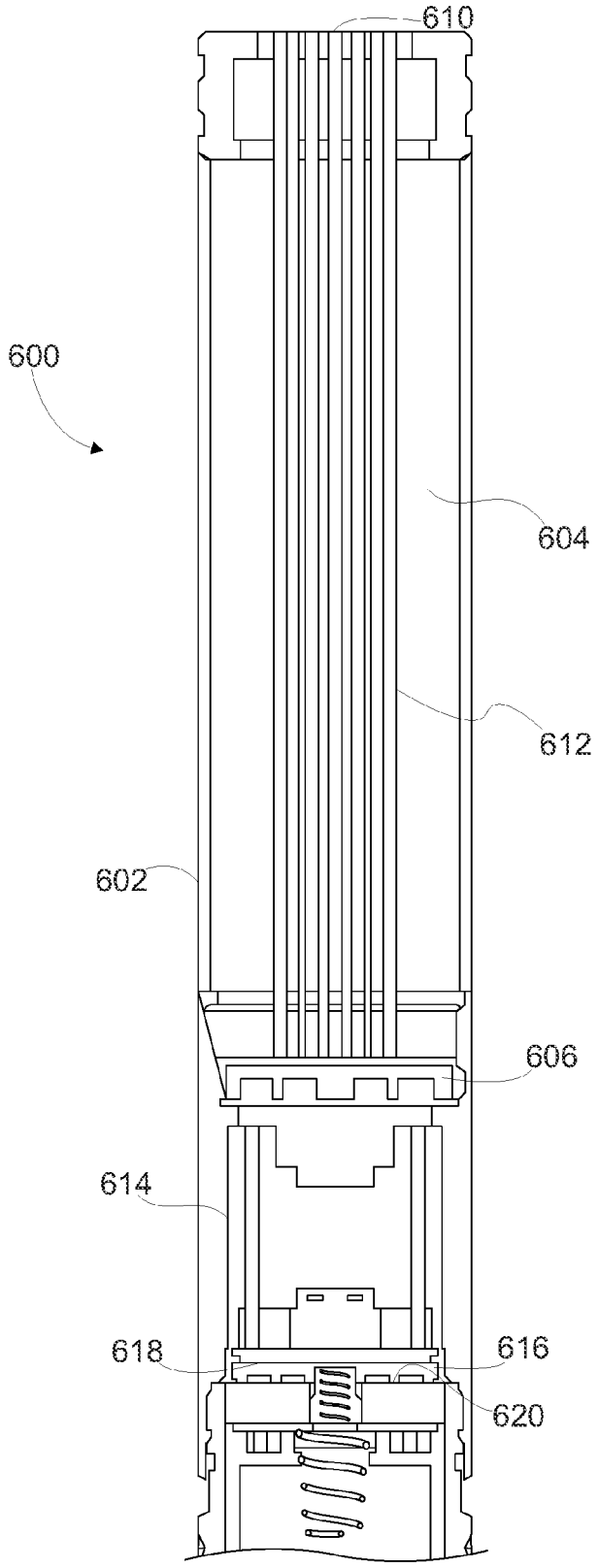

Referring to FIG. 4, a diagram illustrates one embodiment of a circuit 400 that may be used with the flashlight 100 of FIG. 1. It is understood that the circuit 400 is provided for purposes of example and that many different circuits may be used to provide some or all of the functionality described herein for the flashlight 100. In the present example, the two switches 106 (SW2) and 110 (SW1) are double pole, single throw switches and sensor 122 is a Reed switch. LED 112 is controlled by the switch positions and logic provided by integrated circuits 402 and 404, which drive LED 112 via transistor Q1. Direct current (DC) input at J1 may be approximately 4.5 volts and 1 amp, VCC may be approximately 3.7V and 2800 mAh, and VDD may be approximately 2.5V-3.3V. It is understood that these values are for purposes of example only, and that the circuit 400 may be designed for other values of voltage and/or current.

Referring to FIGS. 5A-5E, one embodiment of the flashlight 100 of FIG. 1 is illustrated with a modular extension unit 500. In the present example, the modular extension unit 500 provides an additional power source for the flashlight 100. The modular extension unit 500 replaces the tail cap 108 and attaches to the housing 102 in the same manner as the tail cap 108. For example, if the tail cap 108 is threadably engaged to the housing 102, then the modular extension unit 500 will threadably engage to the housing 102. This enables the modular extension unit 500 to be quickly brought into service without the need to reconfigure the flashlight 100 from its base configuration except for removal of the tail cap 108.

The modular extension unit 500 includes a substantially cylindrical housing 502 that contains a cavity 504 that is accessed by removing a module tail cap 506. The cavity 504 is sized to receive one or more batteries 505, such a Li-ion battery. The module tail cap 506 may include a spring 508 that may both ensure that the battery 505 is secured against a contact on the opposite end and serve as an electrical terminal for the negative end of the battery 505 (or positive end if the modular extension unit is designed to receive the battery in a different manner).

On the opposite end, the modular extension unit 500 is similar to the end cap 108. Accordingly, a retention member 508 is positioned to retain the battery 505 in the cavity 504. The retention member 508, which may itself be conductive or include conductive traces, may include an opening 510. The retention member 508 may form a cavity 512 with an upper surface 514 of a lower member 516, although this cavity may not exist in other embodiments. The upper surface 514 may include one or more contacts to engage a terminal of the battery 505. A lower surface 518 of the lower member 516 is configured to electrically engage the battery holder 116. Accordingly, the lower surface 518 includes three separate contacts (e.g., partial or complete concentric metal circles) that are positioned to engage opposing contacts on the battery holder 116. Accordingly, power may flow from the battery 505 through the contacts to the battery holder 116. As with the tail cap 108, various contacts and traces provided by the modular extension unit 500 are needed to complete the main circuit for the LED 112.

Referring to FIGS. 6A-6F, one embodiment of the flashlight 100 of FIG. 1 is illustrated with a modular extension unit 600. In the present example, the modular extension unit 600 provides an additional light source for the flashlight 100. The modular extension unit 600 replaces the tail cap 108 and attaches to the housing 102 in the same manner as the tail cap 108. For example, if the tail cap 108 is threadably engaged to the housing 102, then the modular extension unit 600 will threadably engage to the housing 102. This enables the modular extension unit 600 to be quickly brought into service without the need to reconfigure the flashlight 100 from its base configuration except for removal of the tail cap 108.

The modular extension unit 600 includes a substantially cylindrical housing 602 that contains a cavity 604. The cavity 604 contains one or more light sources (e.g., LEDs) (not shown) on a substrate 606. In the present embodiment, the LEDs are positioned to project light parallel to a longitudinal axis of the housing 602. A tail cap 608, which may or may not be removable, may include at least a portion 610 (e.g., a window) formed from a material (e.g., a transparent or translucent plastic) that allows the passage of light (represented by light beams 612), thereby enabling light projected by the LEDs to exit the tail cap 608. Some or all of the housing 602 wall may also be formed of a material (e.g., a transparent or translucent plastic) that enables light to pass. It is understood that varying the amount and/or location of the material within the wall enables many different lighting needs to be met. Furthermore, by varying the color of the LEDs and/or the color of the material, different colors of lights may be provided.

The modular extension unit 600 includes a switch 614 that may be used to actuate the LEDs in the modular extension unit 600. The switch 614 may be configured as previously described with respect to switches 106 and 110 (e.g., with multiple states and pressure sensitivities) or may be differently configured. For example, the switch 614 may be used to toggle the LEDs through an OFF state, a CONSTANT ON state, and a STROBE state.

Power for the modular extension unit 600 is obtained from the battery contained in the battery holder 116. Accordingly, the modular extension unit 600 includes a lower member 616 that has an upper surface 618 facing the switch 614 and a lower surface 620 facing the battery holder 116. The lower surface 620 is configured to electrically engage the battery holder 116. Accordingly, the lower surface 620 includes three separate contacts (e.g., partial or complete concentric metal circles) that are positioned to engage opposing contacts on the battery holder 116. In some embodiments, actuation of the switch 614 may simply connect/disconnect power to the LEDs without use of the controller board 118. In other embodiments, actuation of the switch 614 may cause a signal to be sent to the controller board 118 and the controller board 118 may handle activation/deactivation of the LEDs.

It is understood that many other modular extension units may be used with the flashlight 100 of FIG. 1. For example, another modular extension unit may provide infrared signaling/marking functionality that could be used to signal or provide a point of reference for a human or for another device equipped with infrared optics. Yet another modular extension unit may provide passive ethyl-alcohol detection functionality that could be used to detect small amounts of ethyl-alcohol in the ambient air and provide a visual and/or audible alert when detection occurs. Still another modular extension unit may provide a chemical (e.g., Oleoresin Capsicum (OC))

dispersing functionality that could be used to provide personal protection by releasing a metered amount of OC or another chemical or compound to a specific targeted area. Another modular extension unit may provide electrical stun functionality that could be used to provide personal protection by disrupting a target person's internal electrical communication system using high-voltage, low-ampere electrical pulses. Furthermore, in some embodiments, modular extension units may be coupled to one another (e.g., stacked) to provide multiple functions. In still other embodiments, a single modular extension unit may provide multiple functions. In other embodiments, a modular extension unit may provide some or all of its own power.

Figure 7A:
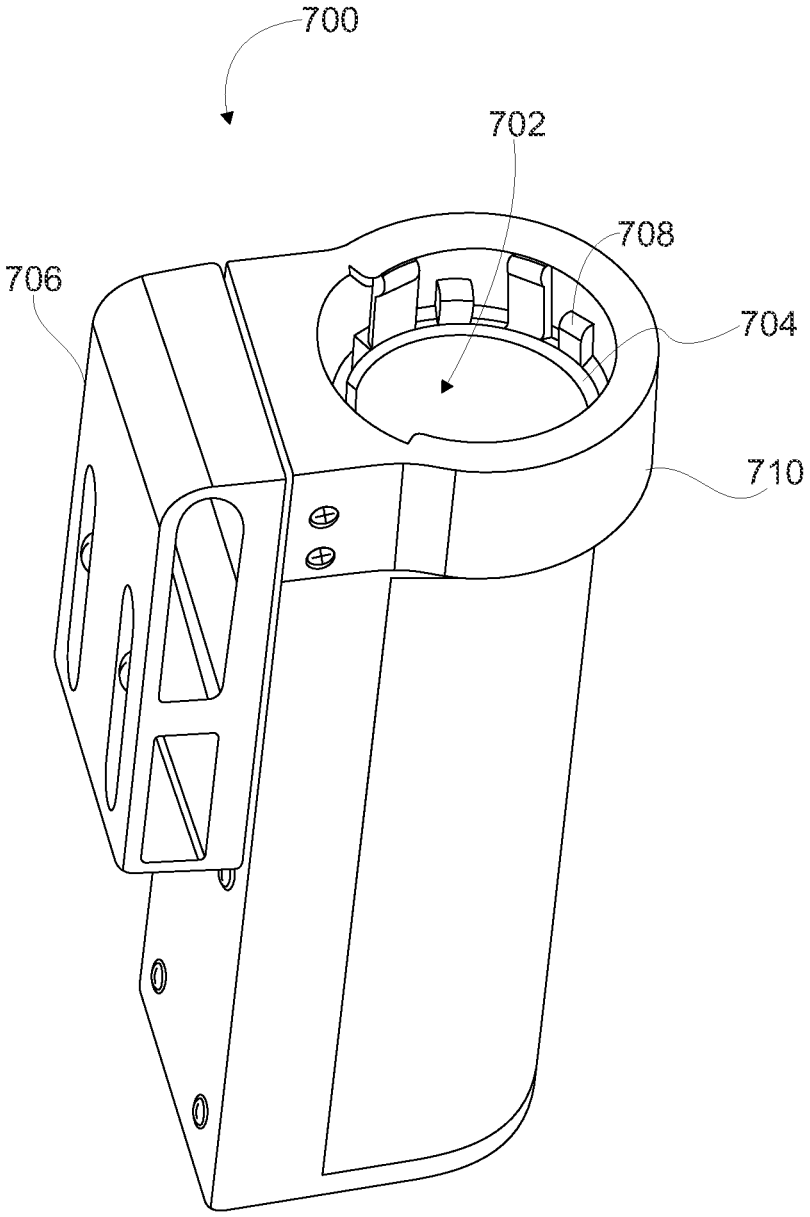
FIG. 7A illustrates a perspective view of one embodiment of a retention device that may be used with the flashlight of FIG. 1A.
Figure 7B:
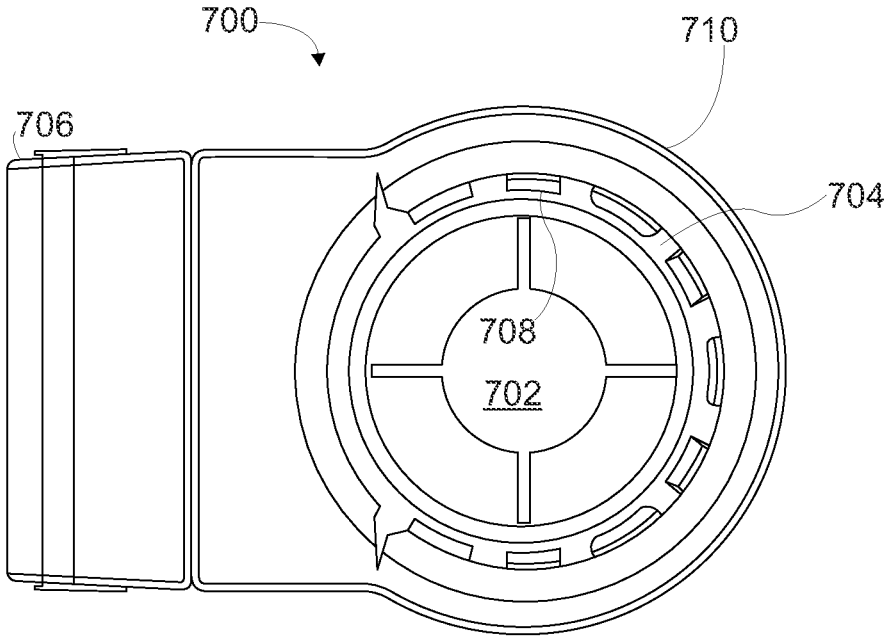
FIG. 7B illustrates a top view of one embodiment of the retention device of FIG. 7A.
Figure 7C:
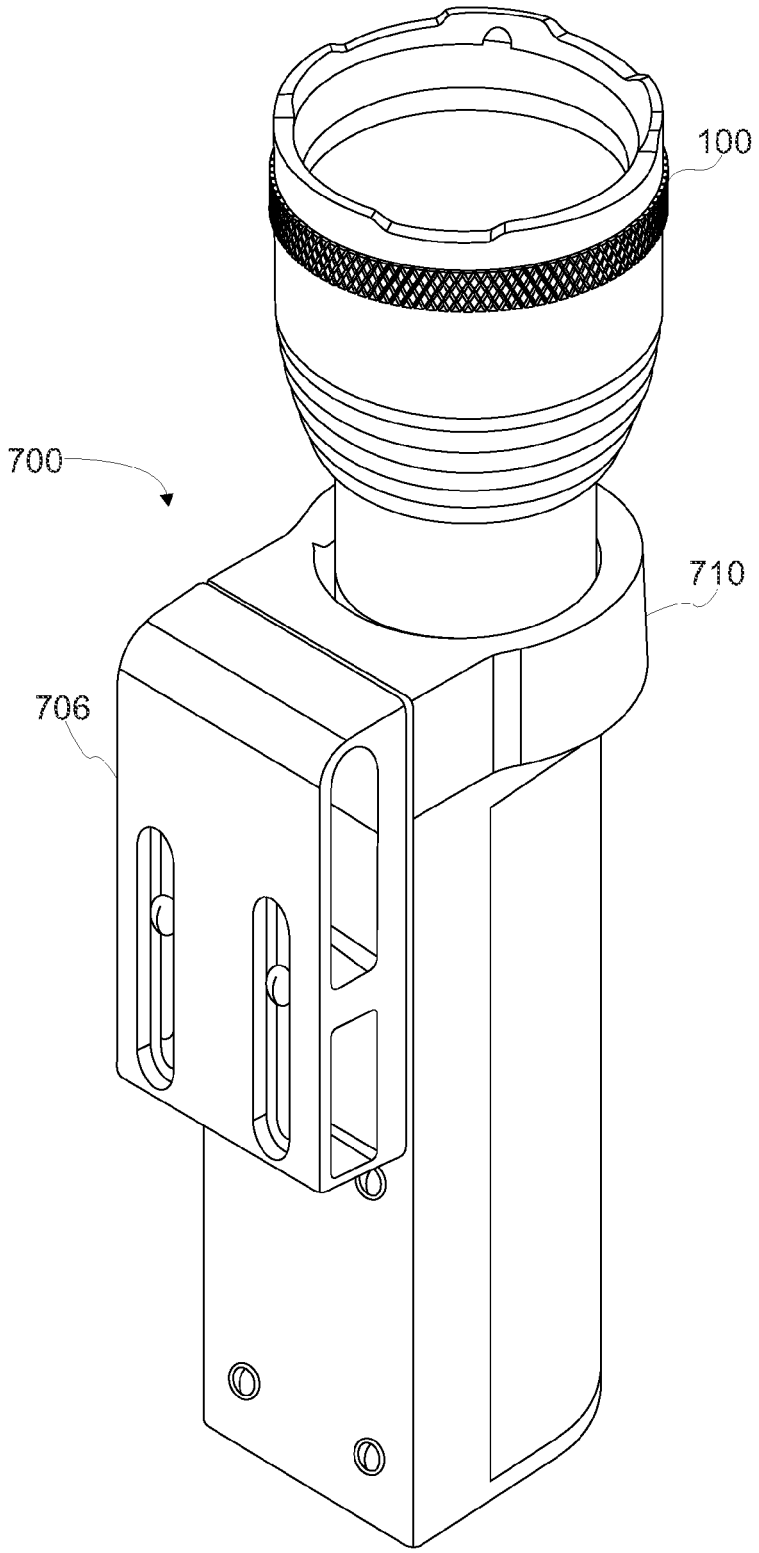
FIG. 7C illustrates a perspective view of one embodiment of the retention device of FIG. 7A retaining the flashlight of FIG. 1A.
Figure 7D:
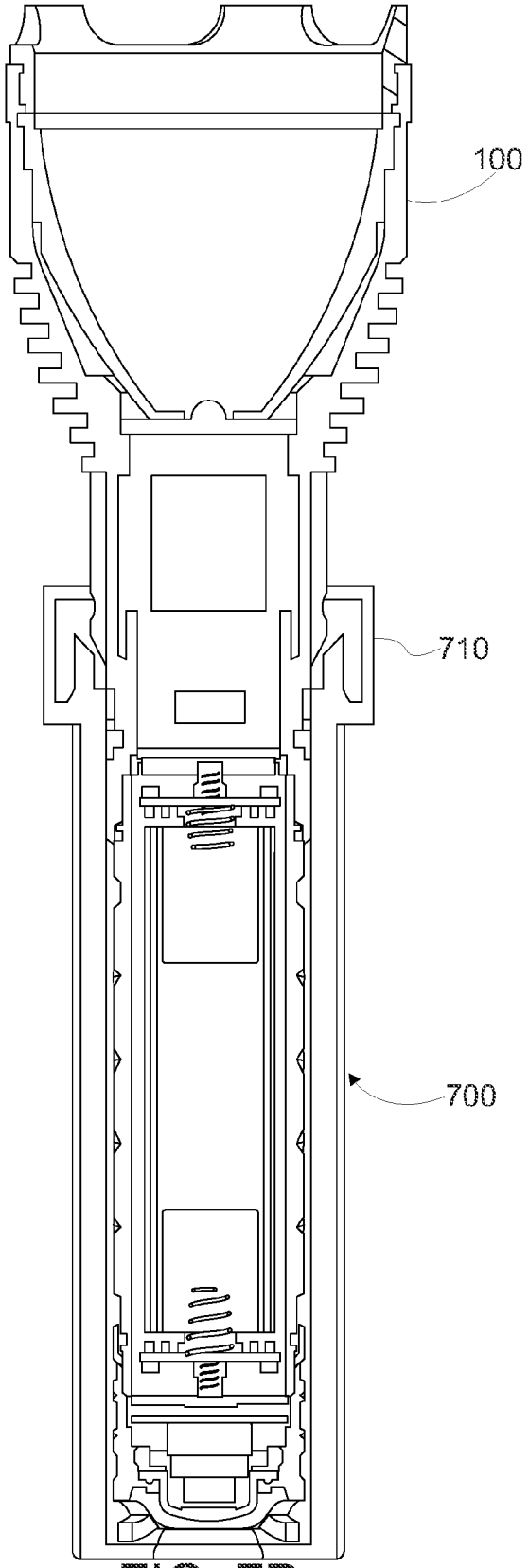
FIG. 7D illustrates a cross-sectional view of one embodiment of the retention device of FIG. 7A retaining the flashlight of FIG. 1A.
Figure 8A:
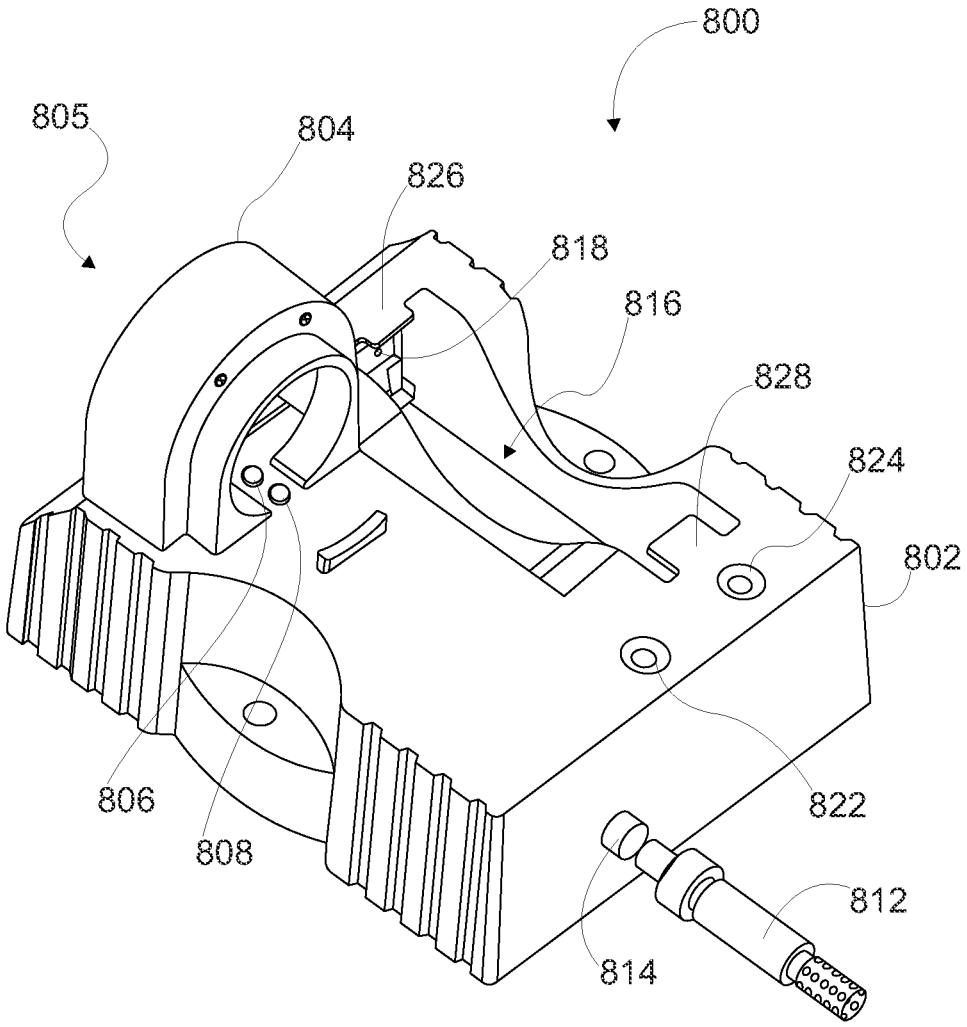
FIGS. 8A and 8B illustrate perspective views of embodiments of a recharging unit that may be used with the flashlight of FIG. 1A.
Figure 8B:
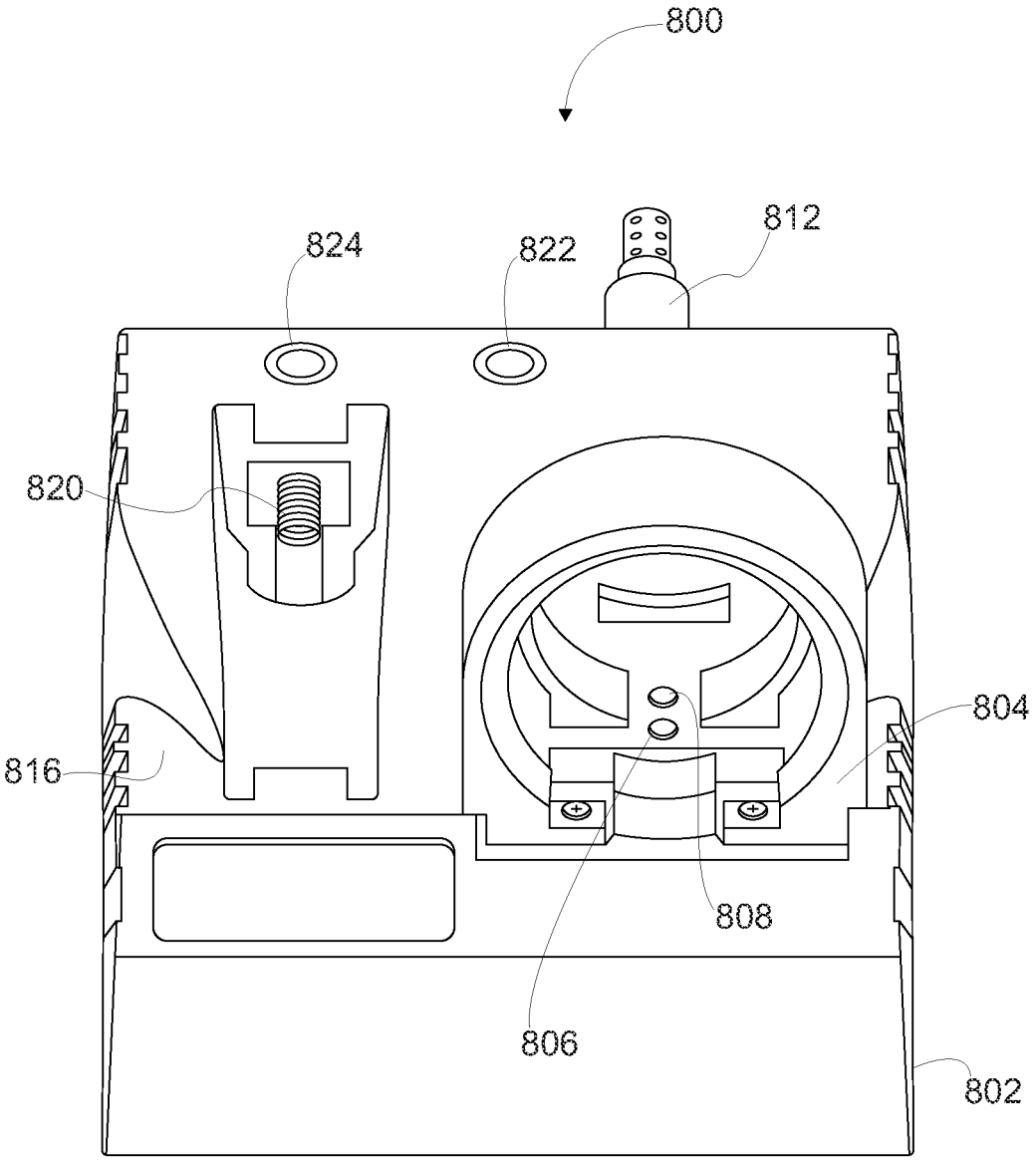
Figure 8C:
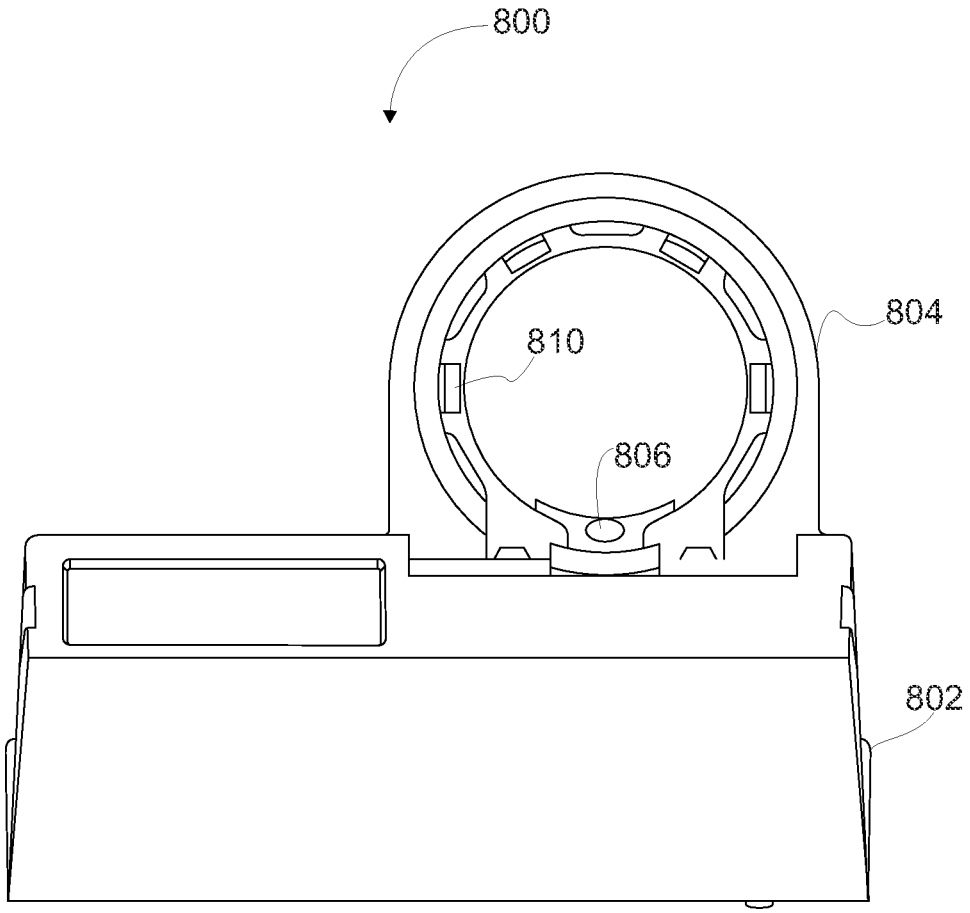
FIG. 8C illustrates a side view of one embodiment of the recharging unit of FIGS. 8A and 8B.
Figure 8D:
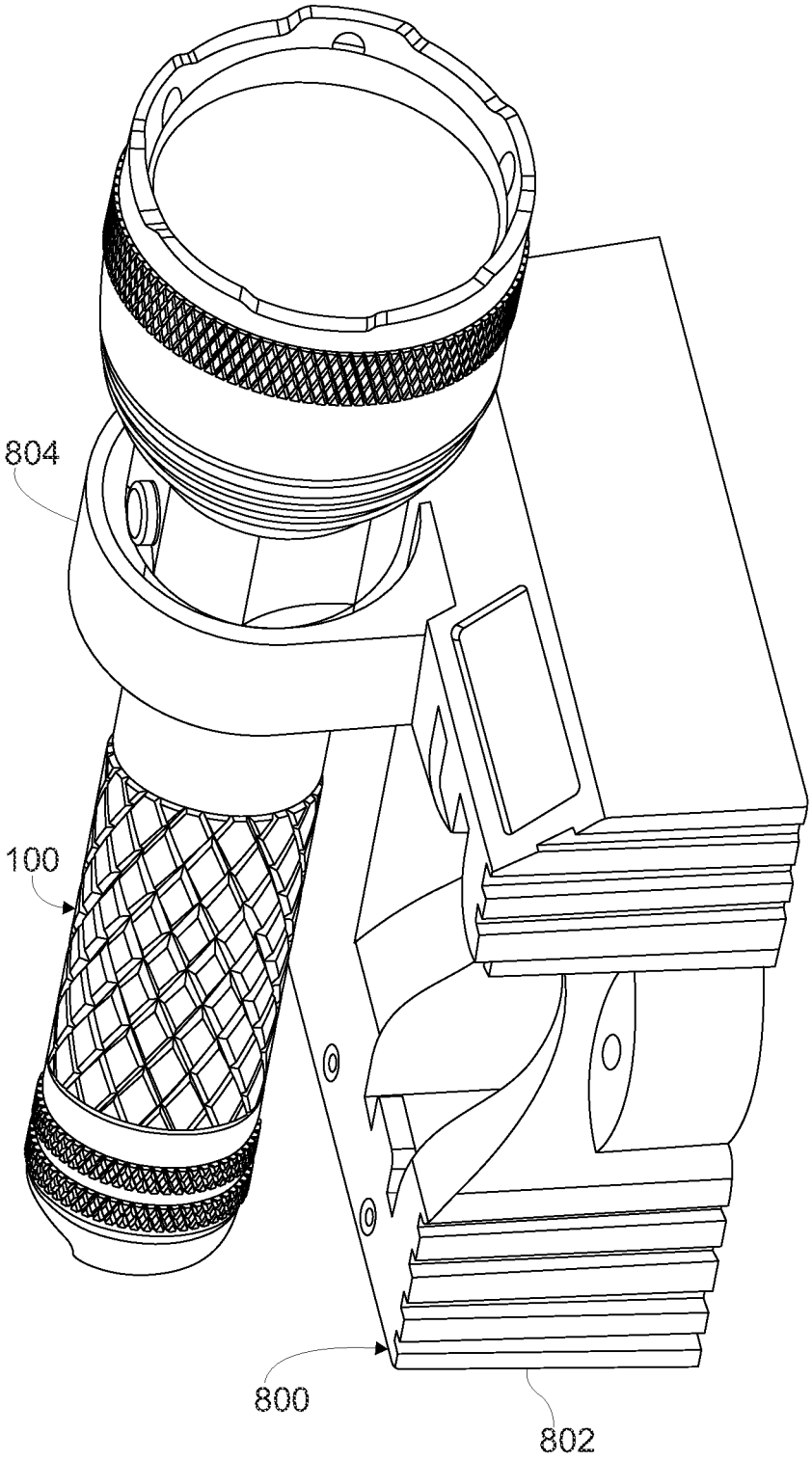
FIGS. 8D and 8E illustrate perspective views of embodiments of the recharging unit of FIGS. 8A and 8B with the flashlight of FIG. 1A.
Figure 8E:
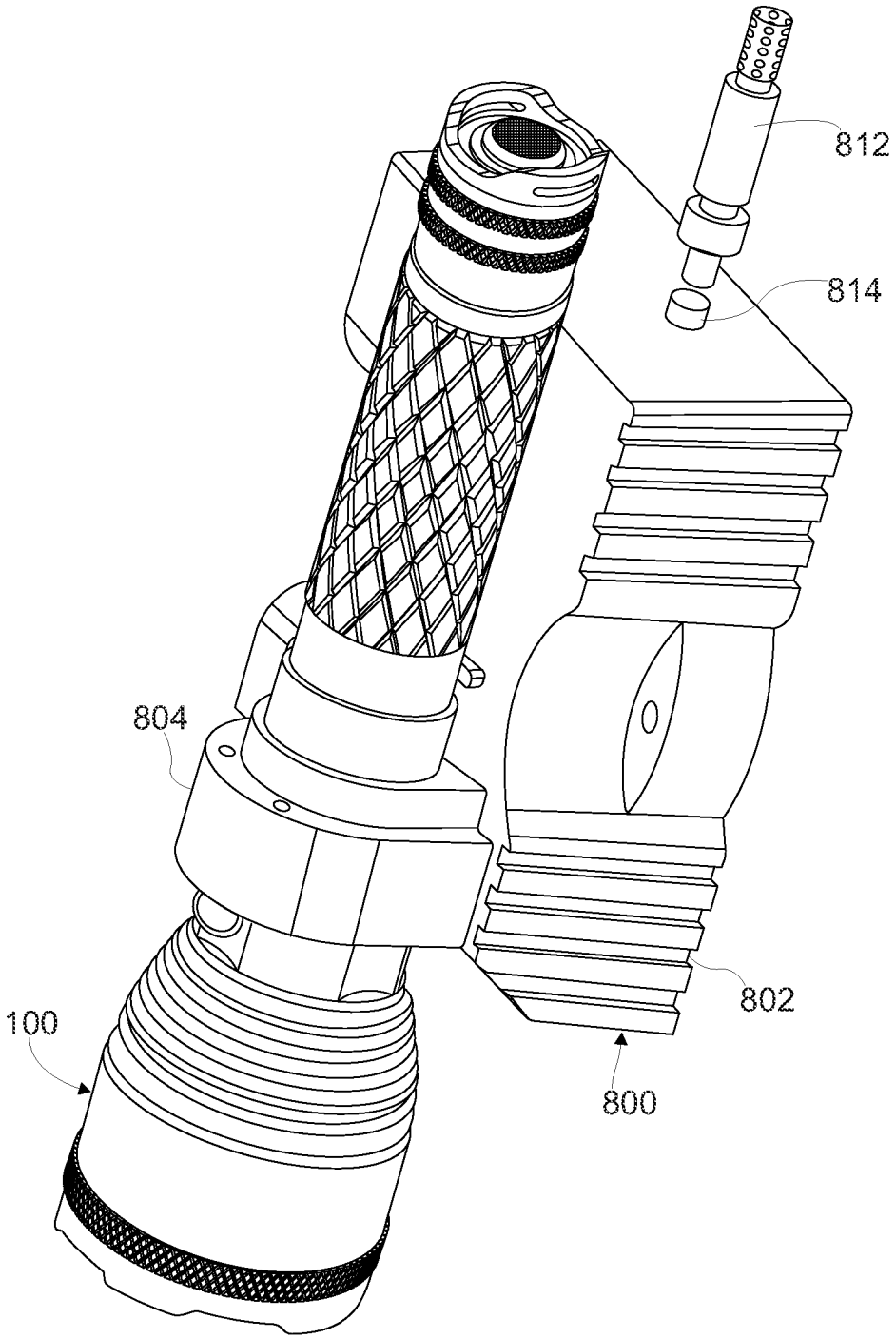
Figure 8F:
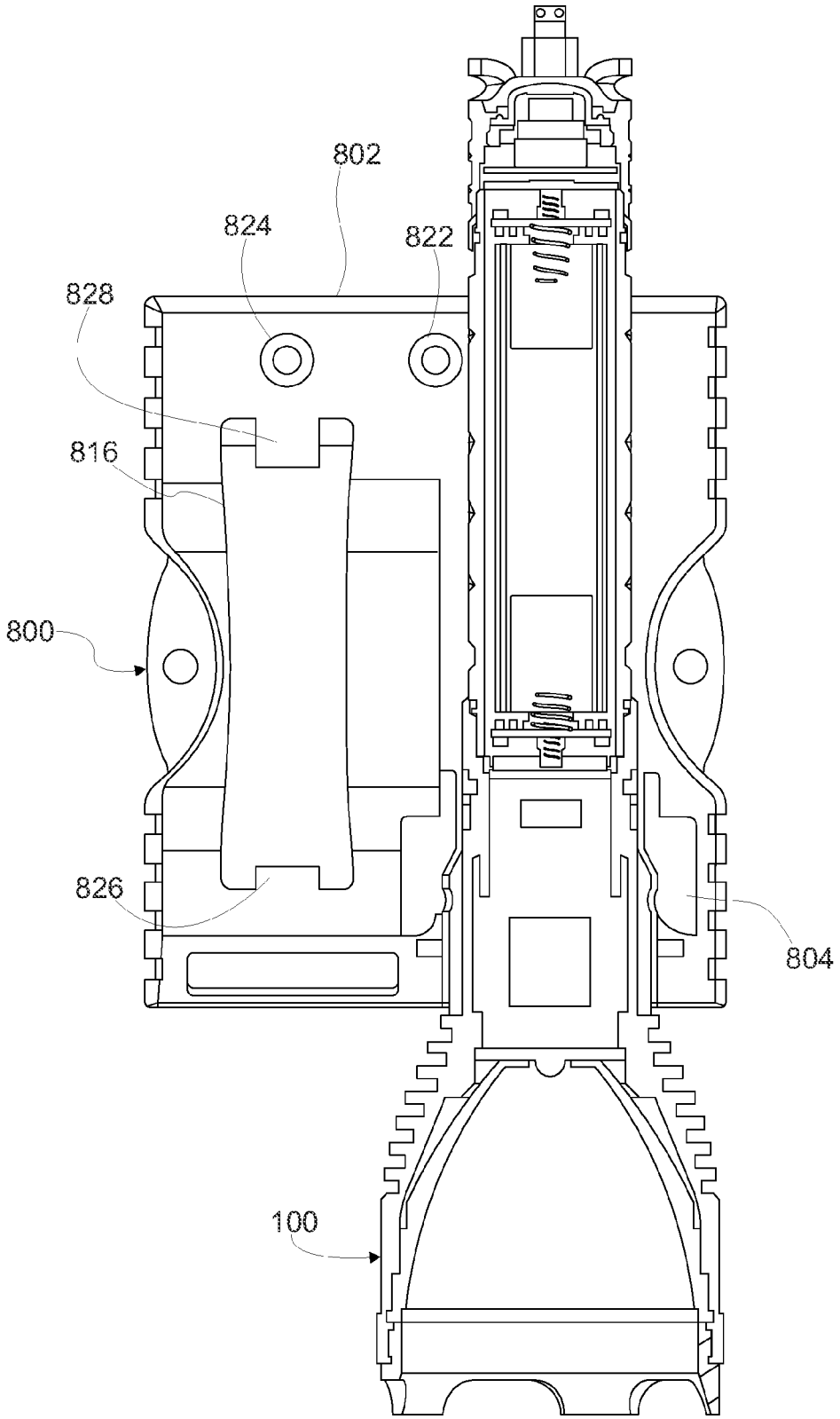
FIG. 8F illustrates a top cross-sectional view of one embodiment of the recharging unit of FIGS. 8A and 8B with the flashlight of FIG. 1A.

Referring to FIGS. 7A-7C, one embodiment of a retention device 700 (e.g., a holster) is illustrated. The holster 700 includes a receptacle 702 for receiving the housing 102 of the flashlight 100 so that the head 104, which is wider than the housing 102, engages a lip 704 and stops the flashlight 100 from sliding through. The holster 700 may have an opening at the bottom to prevent debris and moisture from accumulating and, in some embodiments, to allow the flashlight 100 to be properly holstered when a modular extension unit is attached. A clip 706, which may be adjustable, is provided for attachment to a belt or other available attachment point. When fully inserted into the holster 700, protrusions 708 may engage the notches 128 (FIGS. 1A and 1B) and ensure that the flashlight 100 is not easily dislodged from the holster 700 during physical activity by the user. Although not shown, a magnet or other component (e.g., an RFID tag) may be attached to or embedded within the holster 700 to actuate the previously described sensor 122. For example, the magnet may be embedded in a collar 710.

Referring to FIGS. 8A-8D, one embodiment of a recharging unit 800 is illustrated. The recharging unit 800 includes a base 802 that supports a receiving ring 804. The receiving ring 804 is sized to receive the housing 102 of the flashlight 100. The flashlight 100 is placed into the receiving ring 804 in the direction of arrow 805 until the notches 128 engage protrusions 810 on the interior of the receiving ring 804. The notches 128 and protrusions 810 ensure that two contacts 806 and 808 engage the contacts 124 and 126 on the flashlight 100. The contacts 806 and 808 may be coupled to an external power source (not shown), which is accessed by the recharging unit 800 via a power cord 812 that engages a power receptacle 814 in the base 802.

The base 802 may also include an indention or other designated area 816 for the battery holder 116 or a rechargeable battery. In the present example, the indention 816 includes a positive terminal 818 and a negative terminal 820 that may be coupled to the external power source via the power cord 812. Tabs 826 and 824 may aid in securing the battery holder 116 or battery within the indention 816. Lights 822 and 824 may indicate current charge state via color changes and/or other visual indicators, such as blinking/steady. For example, light 822 may indicate the charge state of the flashlight 100 and light 824 may indicate the charge state of the battery in the indention 816.

The base 802 and/or receiving ring 804 may include a magnet (not shown) positioned for detection by the sensor 122. This prevents inadvertent activation of the flashlight 100 while the flashlight is positioned in the recharging unit 800.

It will be appreciated by those skilled in the art having the benefit of this disclosure that this modular flashlight and modular flashlight system provide a basic flashlight configuration that may be extended using modular extension units. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A modular flashlight comprising:

a base portion having a substantially cylindrical first housing with a first end and a second end;

a head coupled to the first end, the head configured to protect a light source powered by a first power source;

a controller configured to toggle the light source between at least an on state and an off state;

a removable battery holder configured to contain the first power source and fit within the housing, the battery holder providing a first positive/negative terminal pair on a first end facing the head to provide power to the controller and the light source and a second positive/negative terminal pair on a second end facing a tail cap;

a first switch positioned near the head and electrically coupled to the controller, wherein the first switch is configured to provide an input signal to the controller to toggle the light source between the on state and the off state;

a sensor electrically coupled to the controller, wherein the sensor is configured to automatically detect the presence of a component matched to the sensor positioned in a retention device and provide an input signal to the controller to toggle the light source to the off state upon detecting the component matched to the sensor if the light source is in the on state, and to prevent the light source from being toggled to the on state if the light source is in the off state; and the tail cap configured to removably couple to the second end of the first housing, wherein the tail cap includes an electrical connection to the second end of the battery holder, wherein the electrical connection is needed to complete a circuit for the first power source to provide power to the light source; and a second switch configured to toggle the light source between the on state and the off state independently of the first switch; and a modular extension unit having a substantially cylindrical second housing with a third end and a fourth end, wherein the third end is configured to removably couple to the second end of the first housing, wherein the second housing is configured to provide functionality not present in the base portion and to complete the circuit, and wherein only one of the tail cap and second housing can be coupled to the second end at a particular time.

2. The modular flashlight of claim 1 wherein the second housing is configured to provide power to the first housing using a second power source positioned in the second housing.

3. The modular flashlight of claim 1 wherein the second housing is configured to receive power from the first power source.

4. The modular flashlight of claim 3 wherein the second housing includes a second light source coupled to the first power source and a third switch configured to toggle the second light source between at least an on state and an off state.

5. The modular flashlight of claim 4 wherein a sidewall of the second housing is formed at least partially from a material configured to allow light emitted from the second light source to project out of the second housing via the sidewall.

6. The modular flashlight of claim 5 wherein the second light source is formed by at least one light emitting diode (LED) that is positioned to project light parallel to a longitudinal axis of the second housing, wherein the material is configured to refract light from the LED out of the second housing.

7. The modular flashlight of claim 6 wherein the second light source is positioned at the third end and projects light towards the fourth end.

8. The modular flashlight of claim 7 wherein the second housing includes an end cap at the fourth end, wherein the end cap is configured to allow light emitted from the second light source to project out of the second housing via the end cap.

9. The modular flashlight of claim 1 wherein the controller is further configured to toggle the light source through a plurality of on states, and wherein a memory accessible the controller is configured to store a current one of the plurality of on states when the light source is powered off, and wherein the controller is configured to activate the stored on state the next time the light source is powered on.

10. The modular flashlight of claim 1 wherein the sensor is configured to respond to a magnetic field.

11. The modular flashlight of claim 1 wherein the sensor is configured to respond to a radio frequency identification (RFID) tag.

12. A modular flashlight system comprising:

a flashlight having a first housing with a first end and a second end;

a head coupled to the first end, the head protecting a light source powered by a first power source positioned in the first housing;

a controller configured to toggle the light source between at least an on state and an off state;

a first switch positioned near the head and electrically coupled to the controller, wherein the first switch is configured to provide an input signal to the controller to toggle the light source between the on state and the off state;

a sensor electrically coupled to the controller, wherein the sensor is configured to automatically detect the presence of a component matched to the sensor positioned outside of the flashlight and provide an input signal to the controller to toggle the light source to the off state upon detecting the component matched to the sensor if the light source is in the on state, and to prevent the light source from being toggled to the on state if the light source is in the off state; and a tail cap configured to removably couple to the second end of the first housing, wherein the tail cap includes an electrical connection to the first power source needed to complete a circuit for the first power source to provide power to the light source, and a second switch configured to toggle the light source between the on state and the off state independently of the first switch; and a retention device configured to removably receive the first housing so that the sensor is positioned proximate to the component matched to the sensor when the first housing is received into the retention device.

13. The modular flashlight system of claim 12, further comprising a modular extension unit having a second housing with a third end and a fourth end, wherein the third end is configured to removably couple to the second end of the first housing, wherein the second housing is configured to complete the circuit for the first power source to provide power to the light source, and wherein only one of the tail cap and second housing can be coupled to the second end at a particular time.

14. The modular flashlight system of claim 13 wherein the retention device is configured to receive the first housing when the second housing is coupled to the first housing so that the sensor is positioned proximate to the component matched to the sensor when the first housing is fully received into the retention device.

15. The modular flashlight system of claim 12 further comprising a recharging unit having a receiving ring into which the first housing is inserted, wherein electrical contacts on the first housing align with electrical contacts on the recharging unit when the first housing is inserted into the receiving ring.

16. The modular flashlight system of claim 12 further comprising a removable battery holder configured to contain the first power source and fit within the housing, the battery holder providing a first positive/negative terminal pair on a first end facing the head to provide power to the controller and the light source, and a second positive/negative terminal pair on a second end facing the tail cap.

17. The modular flashlight system of claim 16 wherein the tail cap's electrical connection to the first power source includes an electrical connection to the second end of the battery holder.

18. A modular flashlight comprising:

a base portion having a first housing with a first end and a second end;

a head coupled to the first end, the head protecting a light source powered by a first power source positioned in the first housing;

a controller configured to toggle the light source between at least an on state and an off state; and a first switch positioned near the head and electrically coupled to the controller, wherein the first switch is configured to provide an input signal to the controller to toggle the light source between the on state and the off state;

a tail cap configured to removably couple to the second end of the first housing, wherein the tail cap includes an electrical connection to the battery holder needed to complete a circuit for the first power source to provide power to the light source; and a second switch configured to toggle the light source between the on state and the off state independently of the first switch; and a modular extension unit having a second housing with a third end and a fourth end, wherein the third end is configured to removably couple to the second end of the first housing, wherein the second housing is configured to complete the circuit, and wherein only one of the tail cap and second housing can be coupled to the second end at a particular time.

19. The modular flashlight of claim 18 wherein the first power source is a removable battery holder having first and second end, wherein the first end includes a positive electrical terminal and a negative electrical terminal, and wherein the second end includes a positive electrical terminal and a negative electrical terminal.

20. The modular flashlight of claim 18 wherein the second housing is configured to provide power to the first housing using a second power source positioned in the second housing.

21. The modular flashlight of claim 18 wherein the second housing is configured to receive power from the first power source.

* * * * *